US006386813B1

(12) United States Patent
Huber et al.

(10) Patent No.: US 6,386,813 B1
(45) Date of Patent: May 14, 2002

(54) SAFE CONTAINER END CLOSURE AND METHOD FOR FABRICATING A SAFE CONTAINER END CLOSURE

(75) Inventors: William Huber; Peter M. Douglas, both of Bloomsburg, PA (US)

(73) Assignee: H. J. Heinz Company, Pittsburgh, PA (US)

( * ) Notice: Subject to any disclaimer, the term of this patent is extended or adjusted under 35 U.S.C. 154(b) by 0 days.

(21) Appl. No.: 09/838,202

(22) Filed: Apr. 20, 2001

Related U.S. Application Data

(62) Division of application No. 09/134,435, filed on Aug. 14, 1998, now Pat. No. 6,234,337.

(51) Int. Cl.[7] ..... B21D 51/44
(52) U.S. Cl. ..... 413/12
(58) Field of Search ..... 413/8, 12, 14, 413/67; 72/348; 220/269, 270, 273, 276, 906

(56) References Cited

U.S. PATENT DOCUMENTS

| | | | |
|---|---|---|---|
| 3,696,961 | A | 10/1972 | Holk, Jr. |
| 3,838,788 | A | 10/1974 | Stargell |
| 3,941,277 | A | 3/1976 | McKinney et al. |
| 3,986,632 | A | 10/1976 | Morrison et al. |
| 4,052,949 | A | 10/1977 | Woodley |
| 4,106,633 | A | 8/1978 | Lang et al. |
| 4,386,713 | A | 6/1983 | Baumeyer et al. |
| 4,406,378 | A | 9/1983 | Zysset |
| 4,511,299 | A | 4/1985 | Zysset |
| 4,535,909 | A | 8/1985 | Zysset |
| 4,803,136 | A | 2/1989 | Bowsky et al. |
| 4,804,106 | A | 2/1989 | Saunders |
| 4,848,623 | A | 7/1989 | Saunders et al. |
| 5,038,956 | A | 8/1991 | Saunders |
| 5,069,356 | A | 12/1991 | Zysset |
| 5,105,977 | A | 4/1992 | Taniuchi |
| 5,145,086 | A | 9/1992 | Krause |
| 5,169,017 | A | 12/1992 | Cooper et al. |
| 5,174,706 | A | 12/1992 | Taniuchi |
| 5,738,237 | A | 4/1998 | McEldowney |

FOREIGN PATENT DOCUMENTS

| | | |
|---|---|---|
| FR | 2281878 | 3/1976 |

*Primary Examiner*—Nathan J. Newhouse
(74) *Attorney, Agent, or Firm*—Burns, Doane, Swecker & Mathis, L.L.P.

(57) ABSTRACT

A safe container end closure includes an annular central lid portion, an annular peripheral lid portion, and a score line joining the annular central lid portion to the annular peripheral lid portion to permit removal of the central lid portion from the peripheral lid portion. A opening tab is secured to the central lid portion for pivoting movement relative to the central lid portion, with the opening tab having a nose positioned adjacent the score line so that upon pivoting of the opening tab the nose of the opening tab causes a portion of the score line to sever. The closure is formed so that upon removal of the central lid portion, at least the sharp edge on the removed central lid portion is rendered safe. The central lid portion thus includes an outwardly opening intermediate fold and an inwardly opening bottom fold, with the bottom fold extending radially outwardly beyond the score line so that when the central lid portion is separated from the peripheral lid portion at the score line the severed edge on the central lid portion is positioned radially inwardly of the radially outermost portion of the bottom fold. In addition, The score line is in the form of a V-shaped groove having a rounded nose that provides a variety of advantages. The closure also includes a nose spread below the score line defining the extent to which the severed edge of the central lid portion can move. The nose spread in the area of the nose of the opening tab is greater than at other areas along the circumferential extent of the central lid portion.

28 Claims, 19 Drawing Sheets

FIG. 3
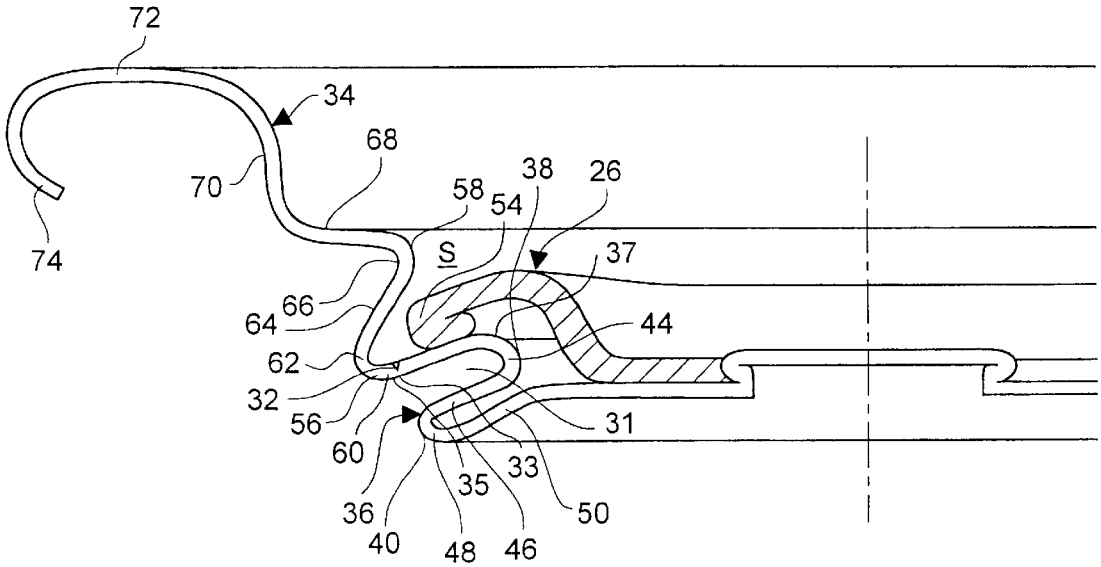
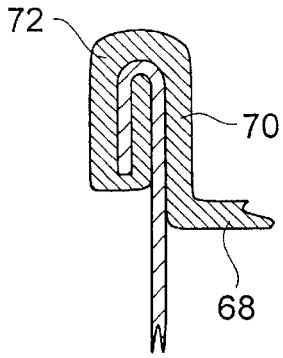
FIG. 4

SAFE CONTAINER END CLOSURE AND METHOD FOR FABRICATING A SAFE CONTAINER END CLOSURE

This application is a divisional of application Ser. No. 09/134,435 filed on Aug. 14, 1998 now U.S. Pat. No. 6,234,337.

FIELD OF THE INVENTION

The present invention generally relates to a container lid. More particularly, the present invention pertains to a safe container lid that is positionable on the open end of a container, with the lid being designed so that upon opening the lid at least the central portion of the lid that is separated from the peripheral portion of the lid remaining on the container possesses a safe edge. The present invention also relates to a method of fabricating such a safe container lid.

BACKGROUND OF THE INVENTION

Containers for holding various type of contents include a variety of different lids. One type of container lid that is commonly used in, for example, canned pet foods, includes a tear line that extends around the lid adjacent the rim. These container lids also include an opening tab that is adapted to be lifted up to sever the tear line along a portion of the lid circumference. The opening tab is then pulled upwardly to completely separate and remove the central portion of the container lid from the peripheral portion of the lid that remains on the container.

While these types of container lids are useful from the standpoint of providing easy access to the container interior, they suffer from certain drawbacks and disadvantages. Perhaps the most significant problem with these types of container lids is that they can be somewhat unsafe. Once the central portion of the container lid has been removed from the remaining peripheral portion, an extremely sharp edge exists on the removed central portion of the lid as well as on the peripheral portion of the lid remaining on the container. The sharp edge on the removed central portion of the lid is potentially hazardous to people handling the removed portion and also presents a danger to others if the removed central portion is discarded in the trash without special precautions being taken. Also, the sharp edge on the peripheral portion of the lid remaining on the container presents a potential hazard during removal of the contents from the container, particularly if the contents are consumed directly from the container. It has been found for instance that in the case of containers of relatively shallow depth, it is not uncommon for individuals to use their fingers to try to remove the entire contents from the container. Thus, the potential for individuals to cut themselves on the sharp edges of these types of containers is rather significant.

Various proposals have been made in the past to configure these types of containers in a way that reduces the risk of injury to users and other individuals. One such proposal is set forth in U.S. Pat. No. 5,105,977. This patent describes a lid provided with a tear line and configured so that upon removal of the central portion of the lid from the remaining portion of the lid, a part of the central portion of the lid extends outwardly beyond the sharp edge of the central portion so that the sharp edge is not exposed. Also, a part of the peripheral portion remaining on the container extends beyond the sharp edge on the peripheral portion so that the sharp edge is not exposed. This is achieved by forming folds in the sidewall of the lid on opposite sides of the tear line.

In practice, however, it has been found that this lid construction is susceptible of certain improvements. In one respect, it is oftentimes necessary to apply a coating (e.g., an enamel coating) to the surface of the lid that will eventually serve as the interior surface of the container lid. In the case of lids made according to the patent described above, this coating is typically applied prior to the fabrication steps associated with the formation of the tear line and the folds in the sidewall. In the disclosed method, the tear line is formed by shallow drawing. This shallow drawing formation of the tear line presents several difficulties.

First, the residual material remaining at the tear line after the shallow drawing tends to be somewhat thick and requires an excessively large rupture force to sever the tear line. More importantly, the shallow drawing method of forming the tear line causes the enamel coating to become separated from the lid because the material forming the lid tends to be stretched by virtue of the shallow drawing. This then requires that the coating on the lid be subjected to a repair operation to correct the damaged portion of the coating. The cost and environmental concerns associated with performing such a repair operation do not make it a very viable alternative.

In addition, the way in which the upper fold is formed in the sidewall of the lid makes it extremely difficult to remove process water from the fold. The upper fold is formed by downwardly inclining a portion of the sidewall and so the space underlying this downwardly inclined sidewall portion is quite small. This thus presents the possibility that corrosion will form on the lid and degrade the integrity of the lid. Further, the formation of the downwardly inclined sidewall portion tends to place stress on the score line which can result in fracturing.

Another area in which the lid described in U.S. Pat. No. 5,105,977 is susceptible of improvements involves other difficulties associated with initially severing the tear line when the opening tab is pivoted upwardly and fully opening the container by pulling up on the opening tab. The lid is configured so that there is very little clearance between the tear line and the portion of the lid sidewall lying immediately below the tear line. This means that at the time the opening tab is pivoted upwardly to sever a portion of the tear line, there is only a very small distance through which the severed edge of the removable plate portion can move downwardly before contacting the underlying portion of the sidewall. At that point, further movement of the severed edge of the removable plate portion is restrained by the underlying portion of the sidewall. As a result, only a small portion of the tear line can be severed during the upward pivoting of the opening tab. There is thus a rather large circumferential extent of the tear line that must be severed by the upward pulling of the opening tab to effect complete removal of the central portion of the lid. It has been found that if the circumferential extent of the tear line that must be severed by the upward pulling of the opening tab is too great, it is difficult, if not impossible, to completely open the lid.

A further area in which the lid described in the aforementioned U.S. patent is susceptible of improvements involves the manufacture of the lid. During the fabrication of the lid, the lid needs to be oriented in the rotational sense to ensure that if the lid is rotated a small amount from one station to the next the lid is nevertheless properly positioned for subsequent fabrication operations. The lid also needs to be properly positioned in the radial sense to avoid side-to-side movement of the lid during the fabrication operations. This proper orientation and positioning of the lid becomes even more significant in high speed manufacturing operations.

In light of the foregoing, a need exists for an improved container end closure which, upon opening, presents a safe edge on at least the removable portion of the closure to prevent injury.

A need also exists for an improved container end closure which, upon opening, presents a safe edge on both the removable portion of the closure as well as the portion of the closure remaining on the container.

It would be desirable to provide a safe container end closure that can be relatively easily opened.

It would also be desirable to provide a safe container end closure that is not susceptible to inadvertent removal of the interior coating on the closure during fabrication of the closure.

It would be further desirable to provide a container end closure that is designed to facilitate the removal of process water to prevent corrosion.

A need also exists for a method of manufacturing a safe container end closure that is relatively easily opened and that does not require reworking of the closure after fabrication to repair damaged coating on the interior of the container end closure.

SUMMARY OF THE INVENTION

According to one aspect of the invention, a safe container end closure positionable on a container includes an annular central lid portion, an annular peripheral lid portion, and a score line joining the annular central lid portion to the annular peripheral lid portion to permit removal of the central lid portion from the peripheral lid portion. The score line is advantageously in the form of a V-shaped score line having a rounded nose. An opening tab is secured to the central lid portion for pivoting movement relative to the central lid portion, with the opening tab having a nose positioned adjacent the score line so that upon pivoting of the opening tab the nose of the opening tab causes a portion of the score line to sever. The central lid portion progressively defines in cross-section, from the score line, an outwardly opening intermediate fold and an inwardly opening bottom fold, with the bottom fold extending radially outwardly beyond the score line so that when the central lid portion is separated from the peripheral lid portion at the score line the central lid portion includes a severed edge that is positioned radially inwardly of a radially outermost portion of the bottom fold.

According to another aspect of the invention, a safe container end closure positionable on a container includes an annular central lid portion, an annular peripheral lid portion, and a score line joining the annular central lid portion to the annular peripheral lid portion and adapted to be severed to permit the central lid portion to be separated from the peripheral lid portion. An opening tab is secured to the central lid portion for pivoting movement relative to the central lid portion, with the opening tab including a nose positioned adjacent the score line so that upon pivoting the opening tab the nose of the opening tab causes a portion of the score line to sever. The central lid portion progressively defines in cross-section, from the score line, an outwardly opening intermediate fold and an inwardly opening bottom fold, with the bottom fold extending radially outwardly beyond the score line so that when the central lid portion is separated from the peripheral lid portion at the score line, the central lid portion includes a severed edge that is positioned radially inwardly of a radially outermost portion of the bottom fold. The intermediate fold is configured to define a gap between the score line and the portion of the central lid portion lying below the score line. This gap defines a distance through which the severed edge is able to move during pivoting of the opening, tab until the severed edge contacts the portion of the central lid portion lying below the score line. This gap is greater along one portion of the circumferential extent of the central lid portion than at other portions.

In accordance with another aspect of then invention, a safe container end closure positionable on a container includes an annular central lid portion, an annular peripheral lid portion, a score line joining the annular central lid portion to the annular peripheral lid portion to permit removal of the central lid portion from the peripheral lid portion, an opening tab secured to the central lid portion for pivoting movement relative to the central lid portion, the opening tab having a nose positioned adjacent the score line so that upon pivoting of the opening tab the nose of the opening tab causes a portion of the score line to sever. The central lid portion progressively defining in cross-section, from the score line, an outwardly opening intermediate fold and an inwardly opening bottom fold, the bottom fold extending radially outwardly beyond the score line so that when the central lid portion is separated from the peripheral lid portion at the score line the central lid portion includes a severed edge that is positioned radially inwardly of a radially outermost portion of the bottom fold;

the peripheral lid portion progressively defining in cross-section, from the score line, an inwardly opening intermediate fold and an outwardly opening top fold, the top fold extending radially inwardly beyond the score line so that when the central lid portion is separated from the peripheral lid portion at the score line the peripheral lid portion includes a severed edge that is positioned radially outwardly of a radially innermost portion of the top fold, the peripheral lid portion further including a horizontal ledge positioned adjacent a rim portion of the peripheral lid portion.

Another aspect of the present invention involves a method of fabricating a safe container end closure that includes positioning a shell in a fabricating machine, forming first and second folds in the sidewall of the shell, with the first fold opening inwardly and the second fold opening outwardly, and pressing a V-shaped die element with a rounded nose against the sidewall of the shell at a place on the sidewall located radially inwardly of the radially outermost extent of the first fold to form in the sidewall a V-shaped score line having a rounded nose. The V-shaped score line divides the sidewall of the shell into a central lid portion positioned on an inner side of the score line and a peripheral lid portion positioned on an outer side of the score line, and the V-shaped score line permits the central lid portion to be severed from the peripheral lid portion. An opening tab is secured to the bottom wall of the shell so that the nose of the opening tab is positioned adjacent the score line.

According to a further aspect of the invention, a method of fabricating a safe container end closure involves positioning a shell in a fabricating machine, forming first and second folds in the sidewall of the shell so that the first fold opens inwardly and the second fold opens outwardly, and forming a score line in the sidewall of the shell at a place on the sidewall located radially inwardly of the radially outermost extent of the first fold to divide the sidewall of the shell into a central lid portion positioned on an inner side of the score line, and a peripheral lid portion positioned on an outer side of the score line. The score line permits the central lid portion to be severed from the peripheral lid portion. The second fold defines a gap between the score line and the portion of the central lid portion lying below the score line, with the gap being greater over a portion of the circumferential extent of the central lid portion than at another portion of the circumferential extent of the central lid portion. An opening tab is secured to the bottom wall of the shell so that the nose of the opening tab is positioned adjacent the score line.

Another aspect of the invention relates to a method of fabricating a safe container end closure that involves placing a shell in a fabricating machine which successively advances the shell along a plurality of stations to form the shell into a safe container end closure, forming a first locating mechanism in the bottom wall of the shell, forming a second locating mechanism in the bottom wall of the shell, and forming a rivet form in the bottom wall of the shell. First and second folds are formed in the sidewall of the shell, with the first fold opening inwardly and the second fold opening outwardly. A score line is also formed in the sidewall of the shell at a place on the sidewall located radially inwardly of the radially outermost extent of the first fold to divide the sidewall of the shell into a central lid portion positioned on an inner side of the score line and a peripheral lid portion positioned on an outer side of the score line. The score line permits the central lid portion to be severed from the peripheral lid portion. An opening tab is secured to the bottom wall of the shell so that the nose of the opening tab is positioned adjacent the score line. The shell is radially located at at least some of the stations through use of the first locating mechanism and is rotationally oriented at at least some of the stations through use of the second locating mechanism to ensure proper radial location and rotational orientation of the shell at the stations.

BRIEF DESCRIPTION OF THE DRAWING FIGURES

Additional features and details associated with the present invention will become more apparent from the following detailed description considered with reference to the accompanying drawing figures in which like elements are designated by like reference numerals and wherein:

FIG. 1 a top perspective view of the upper portion of a container on which is mounted the can end closure according to the present invention;

FIG. 3 is an enlarged cross-sectional view of a portion of the container end closure illustrated in FIG. 2;

Figure 2:
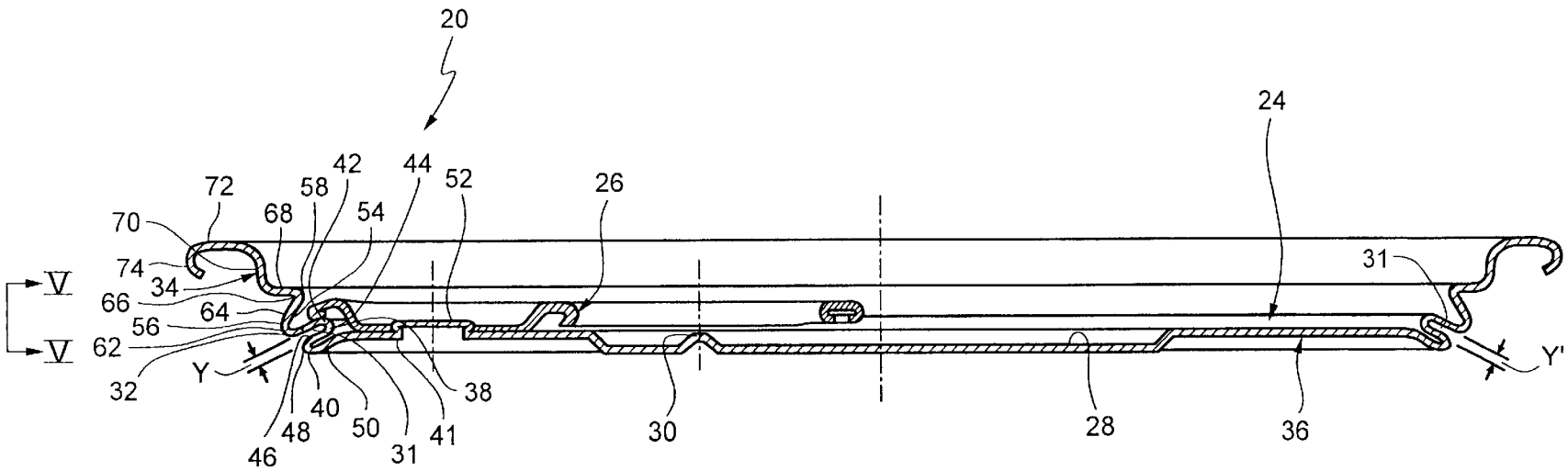
FIG. 2 is a cross-sectional view of the container end closure according to the present invention.
Figure 5:
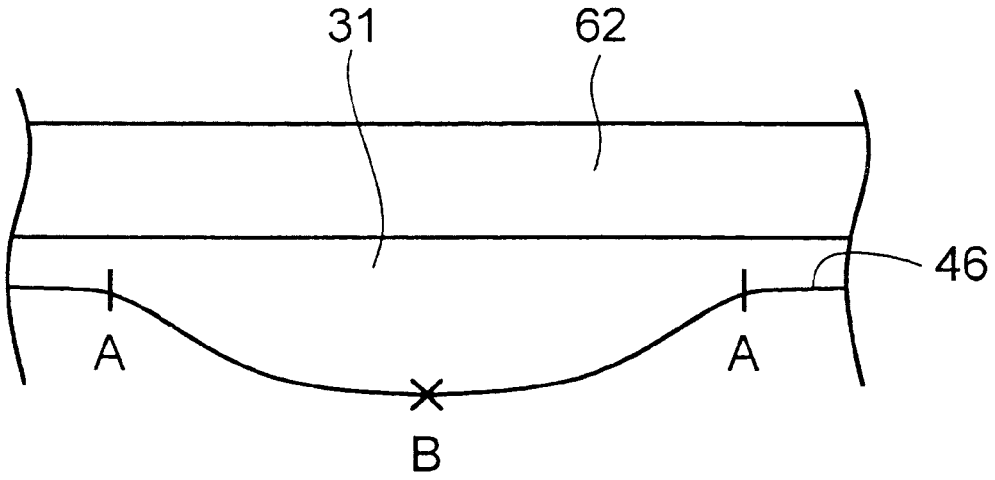
Figure 6:
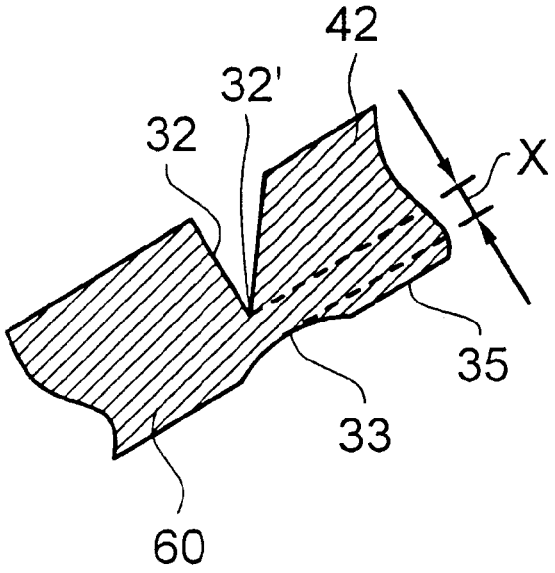
Figure 7:
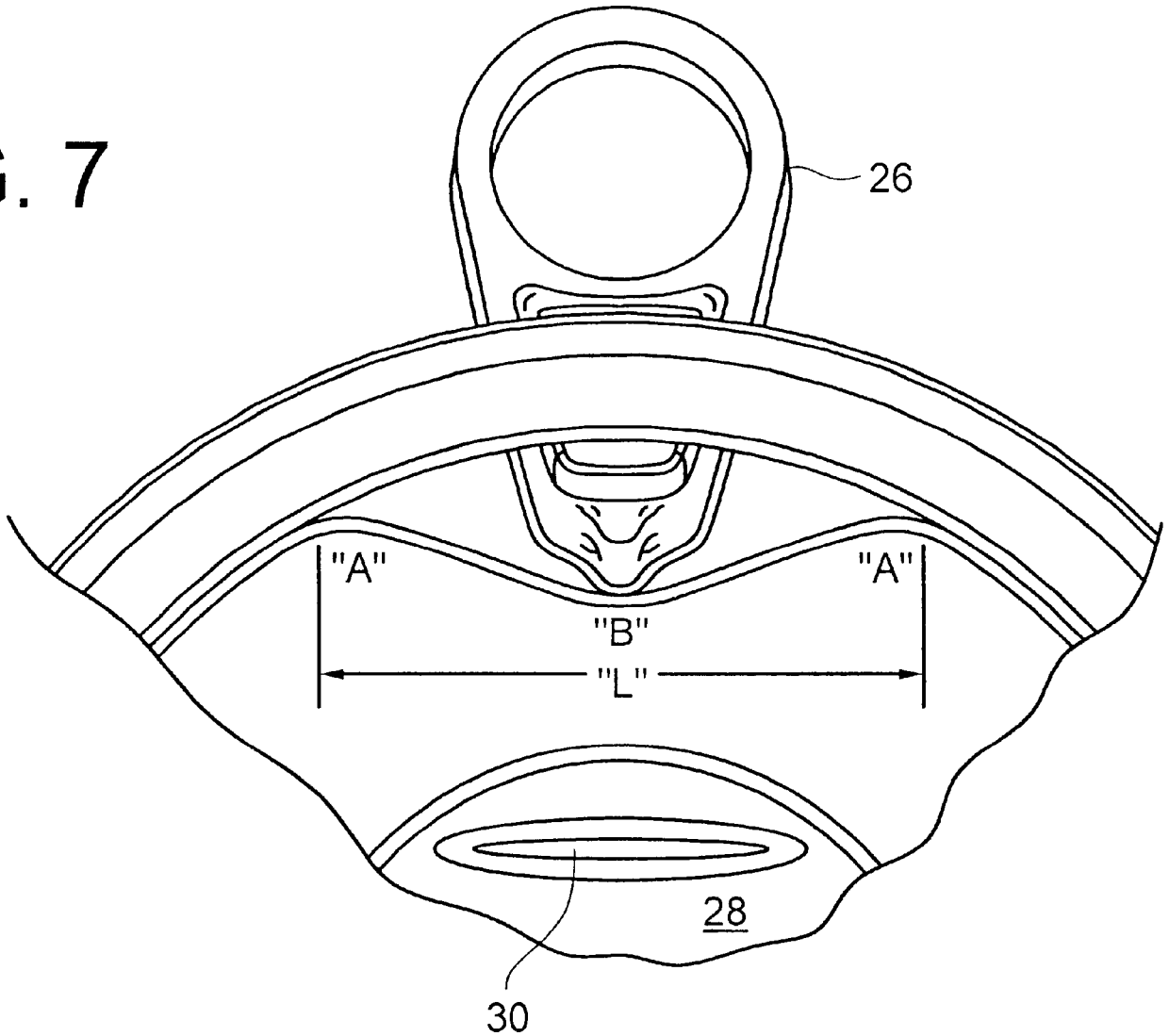
Figure 8:
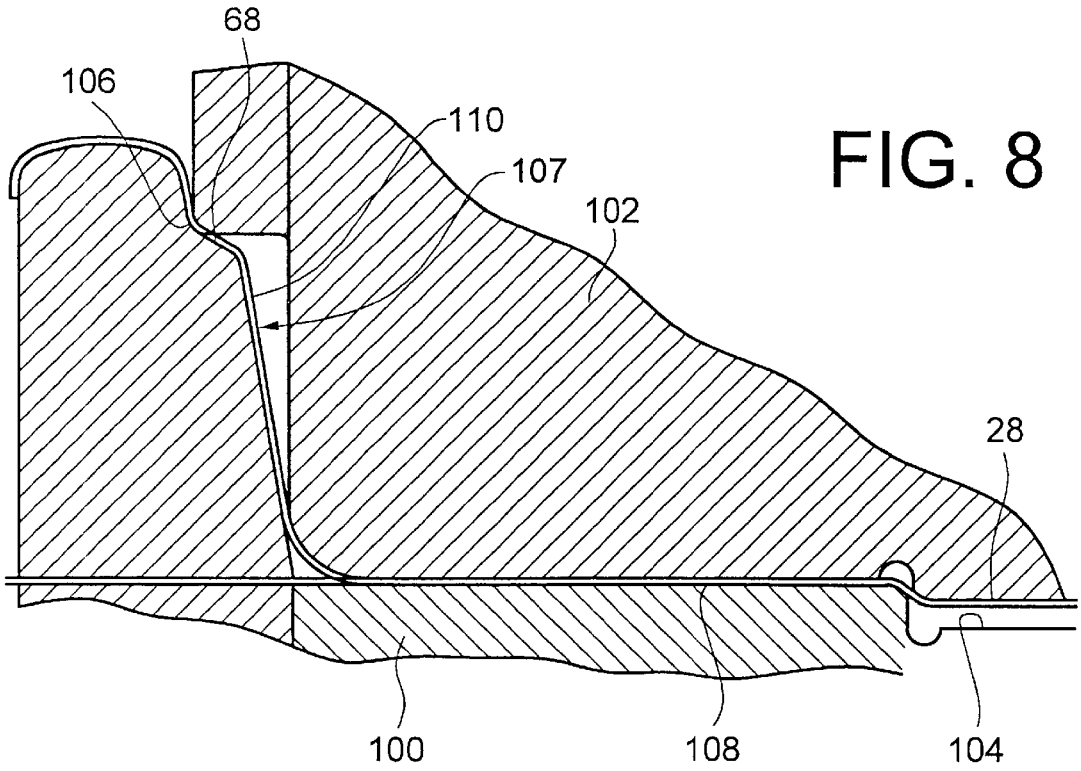
Figure 9C:
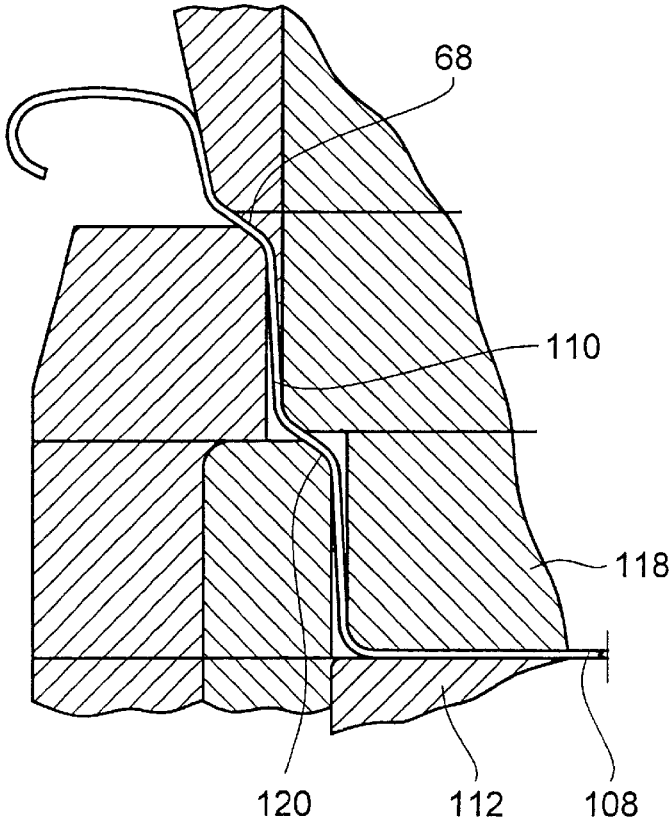
Figure 9A:
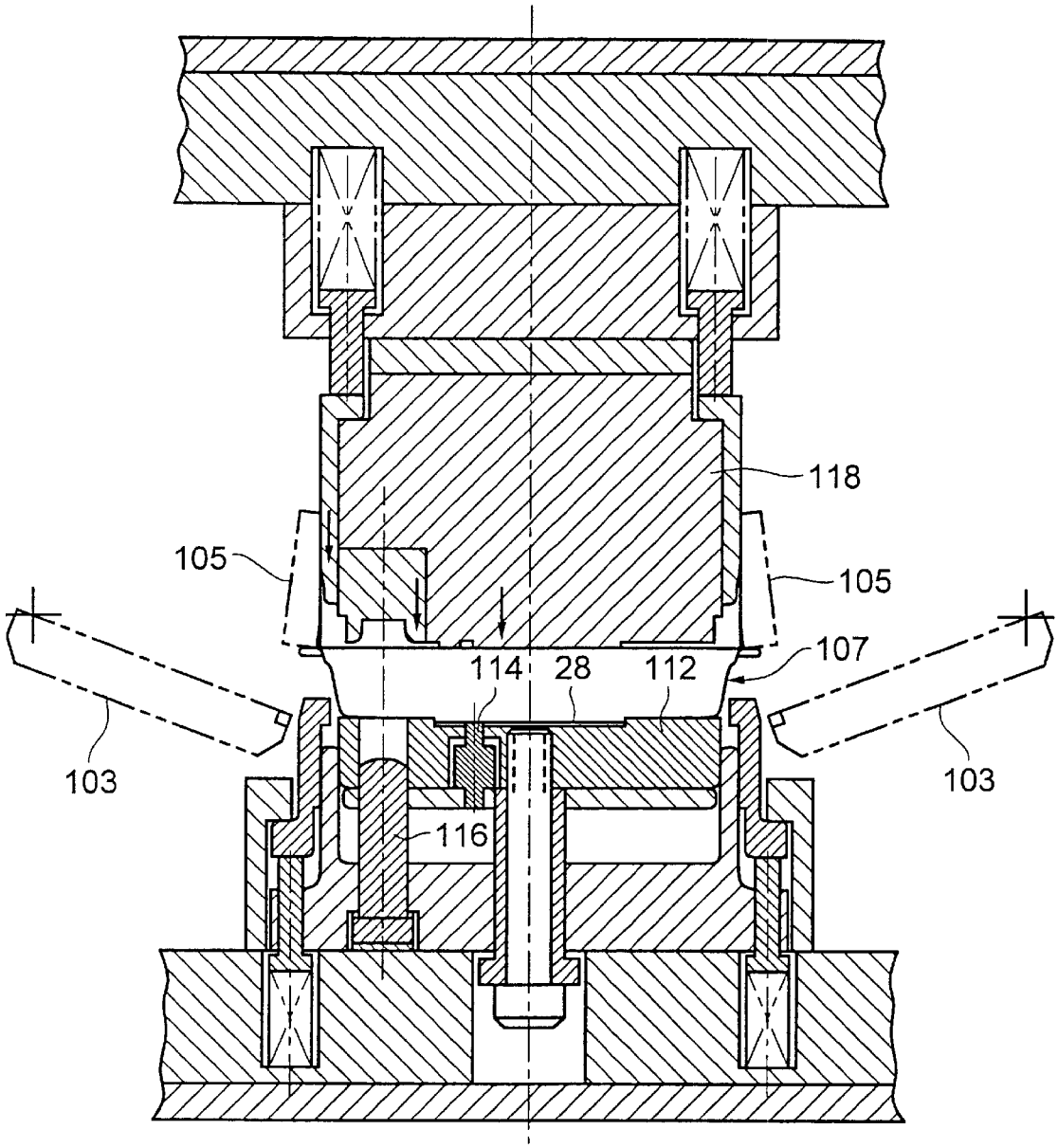
Figure 9B:
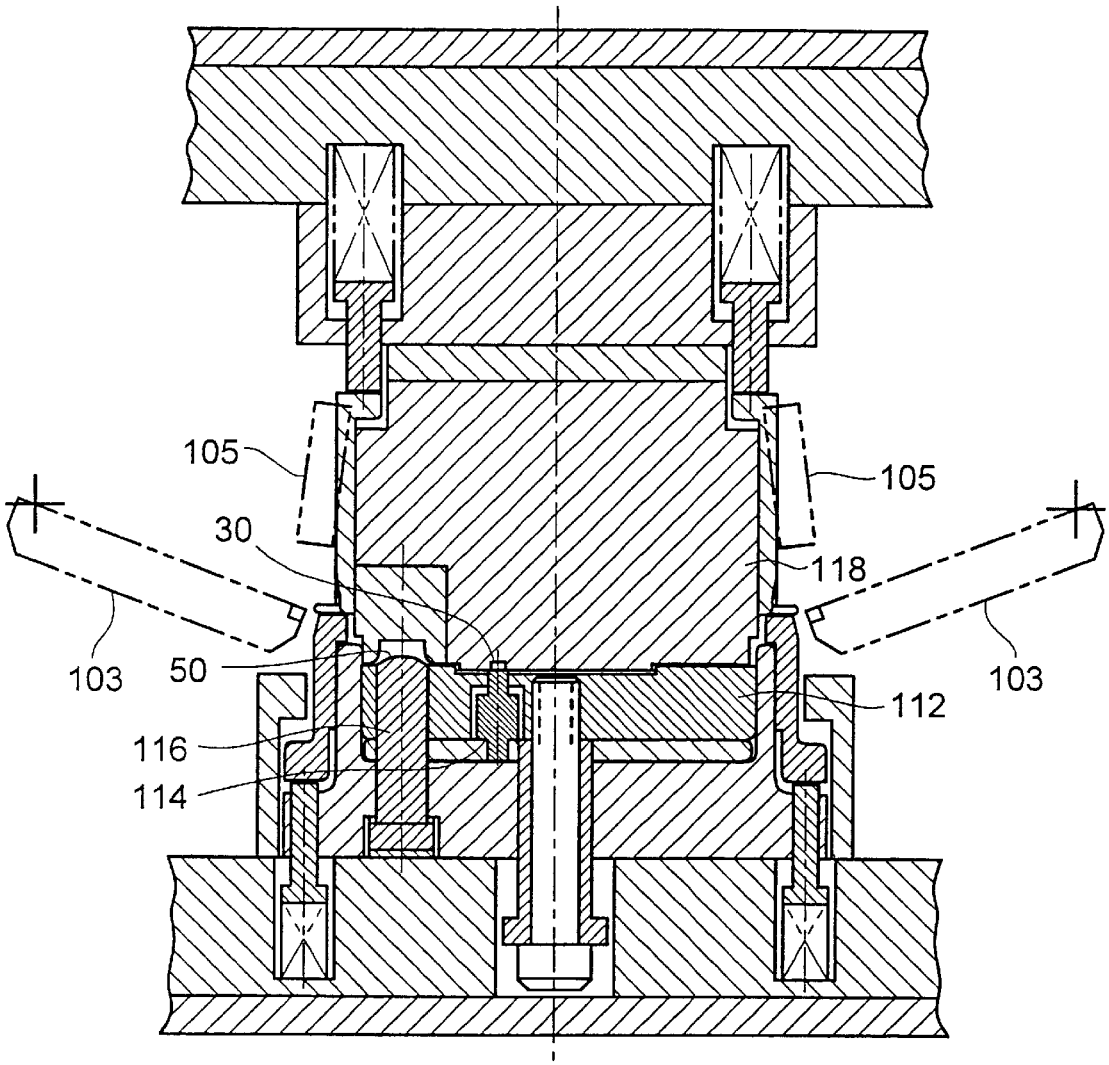
Figure 10A:
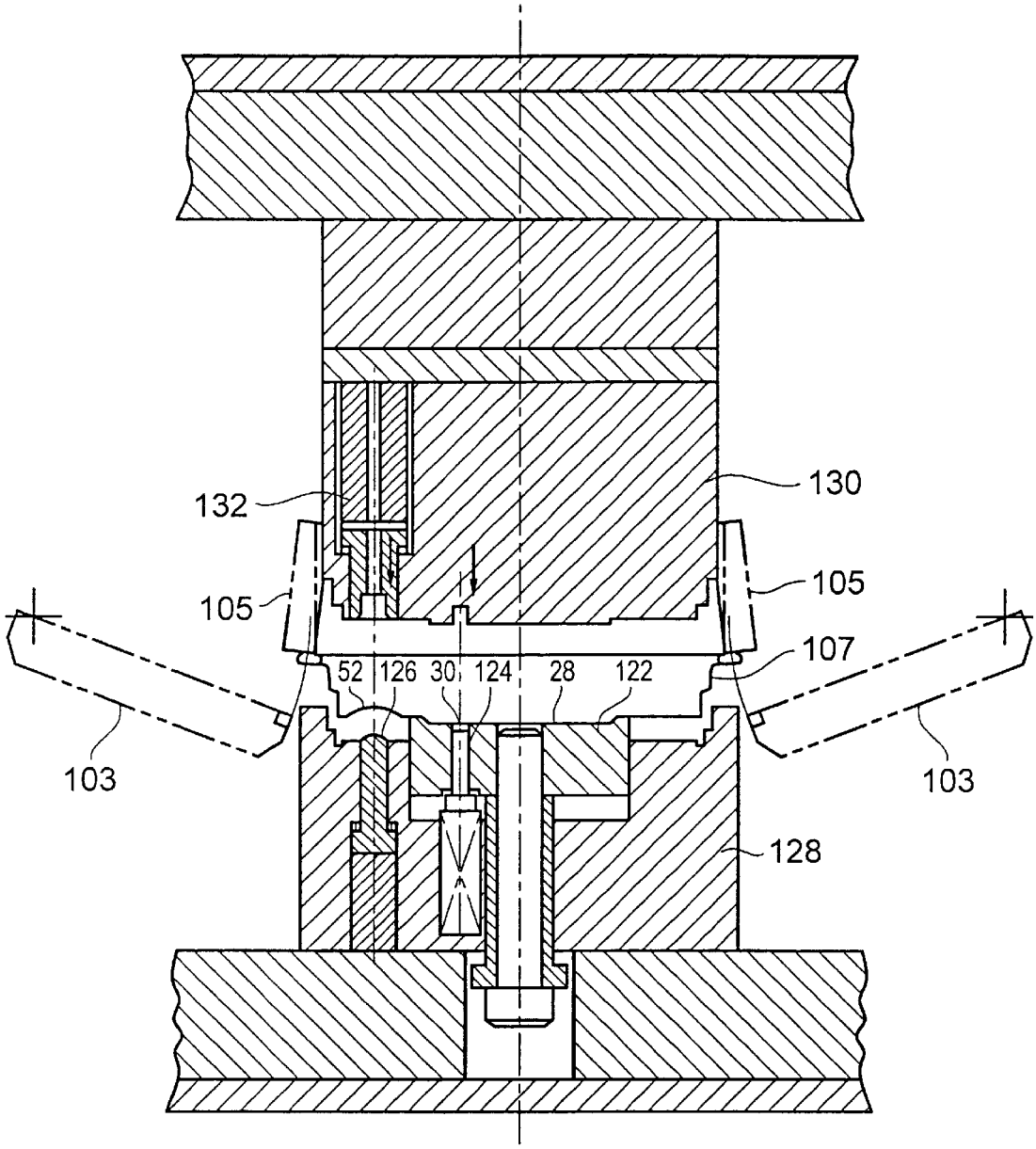
Figure 10B:
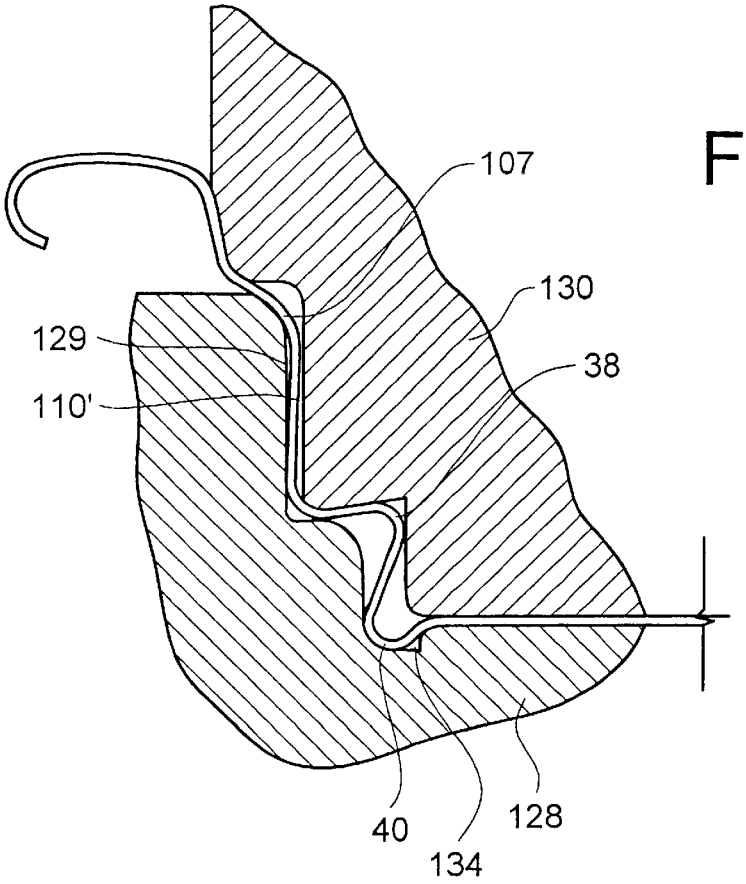
Figure 11B:
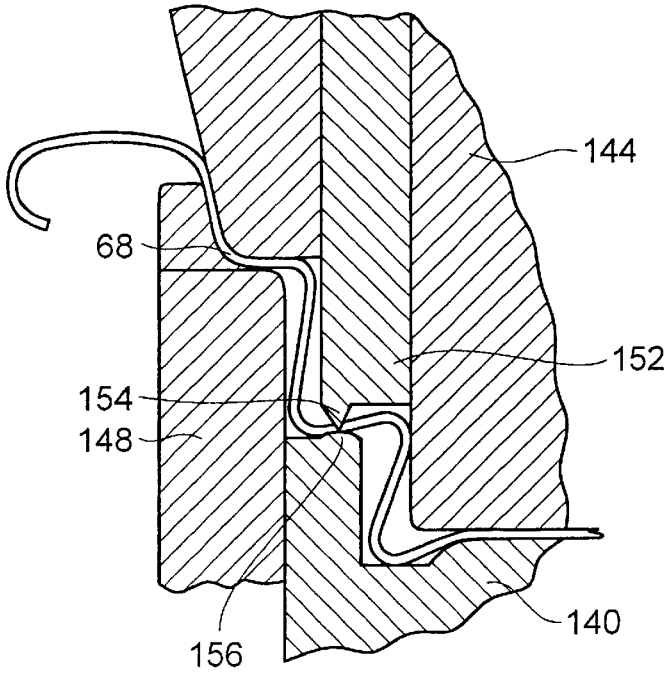
Figure 11A:
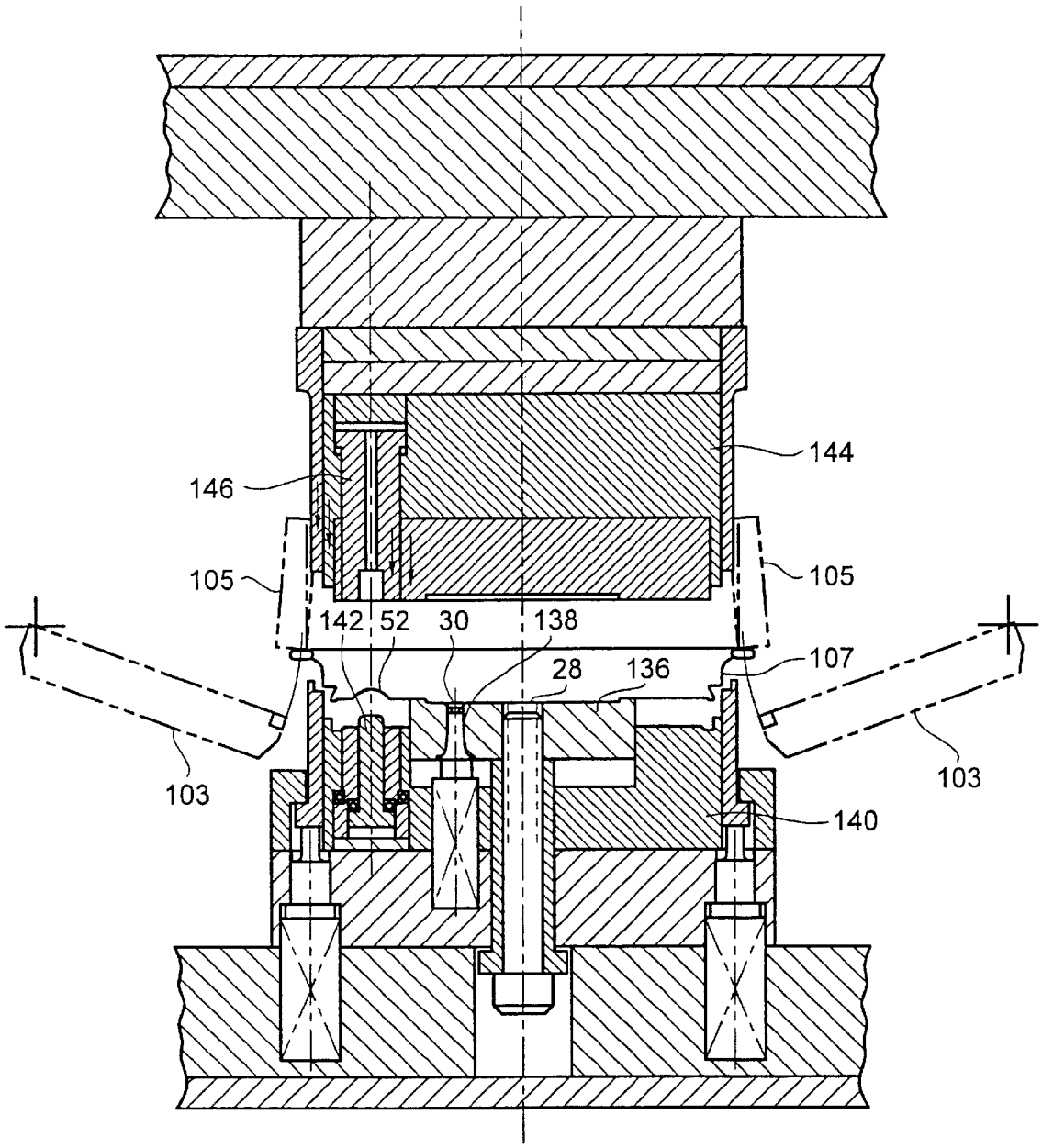
Figure 11C:
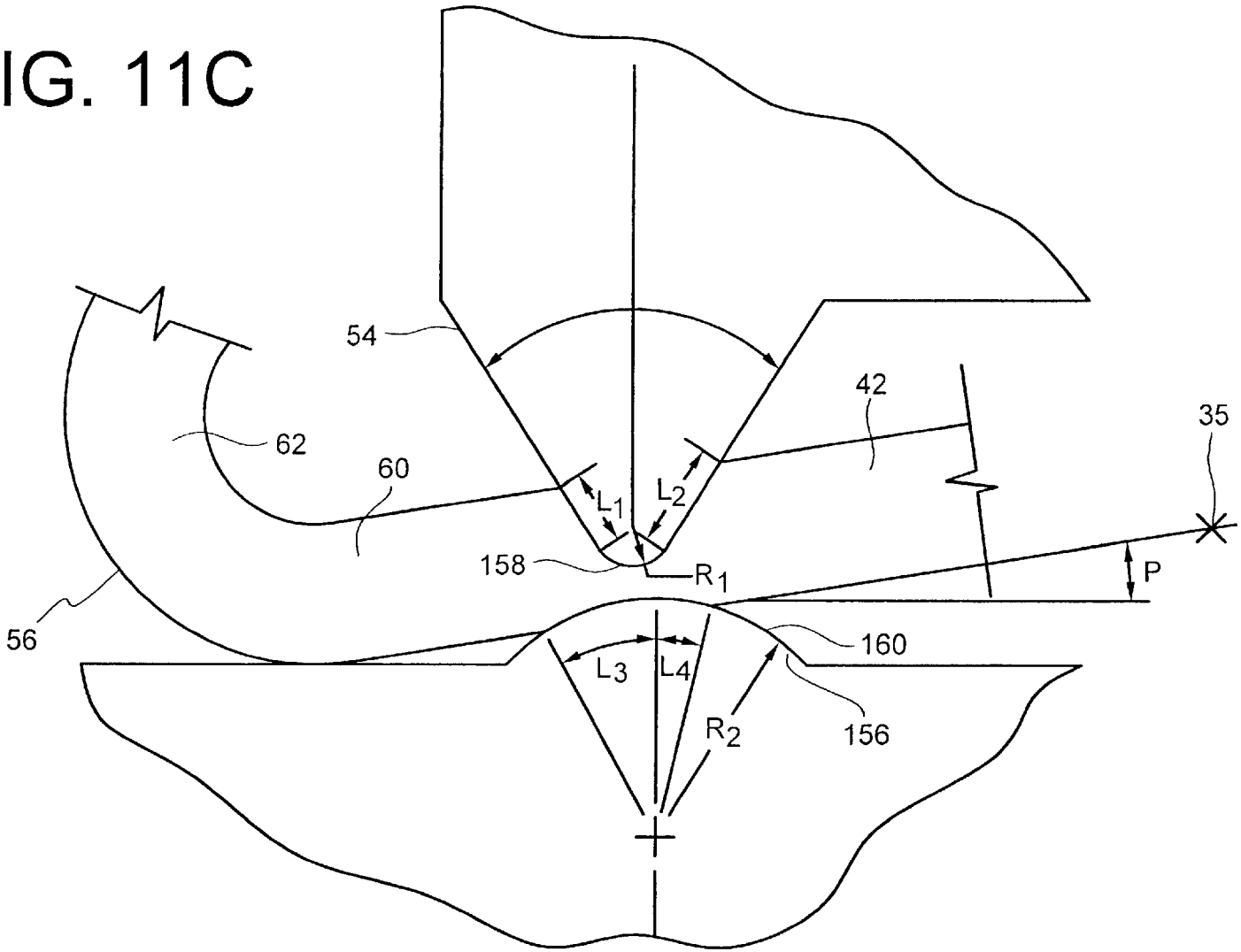
Figure 12A:
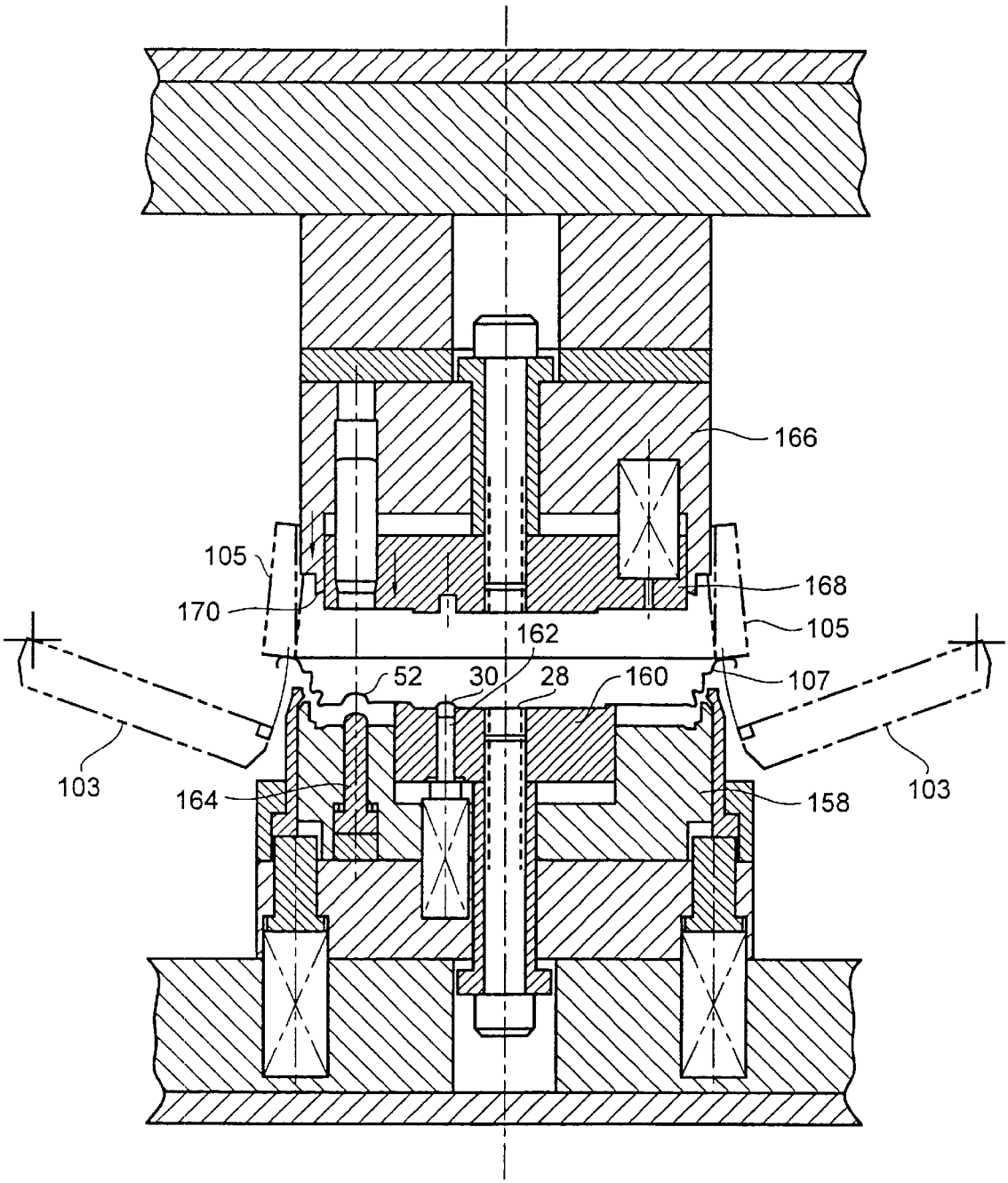
Figure 12B:
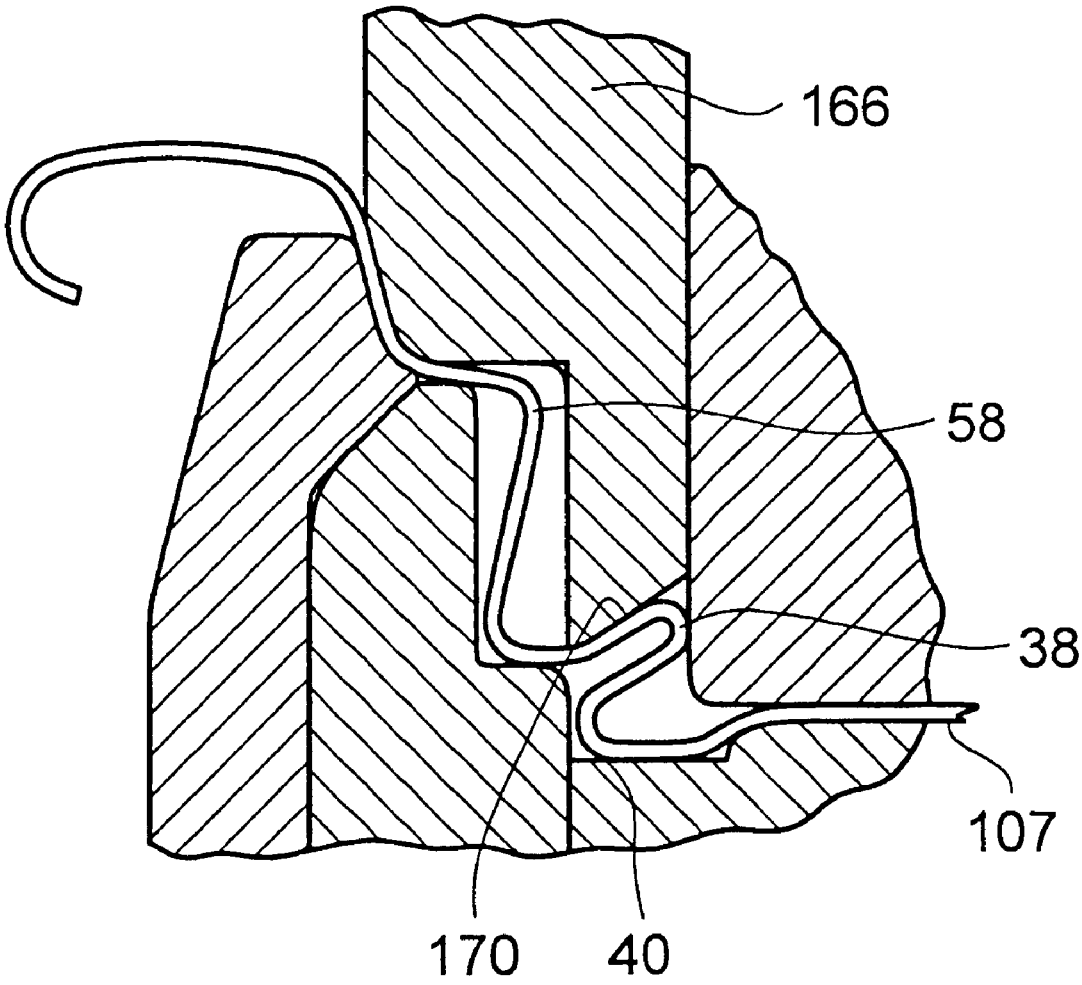
Figure 13:
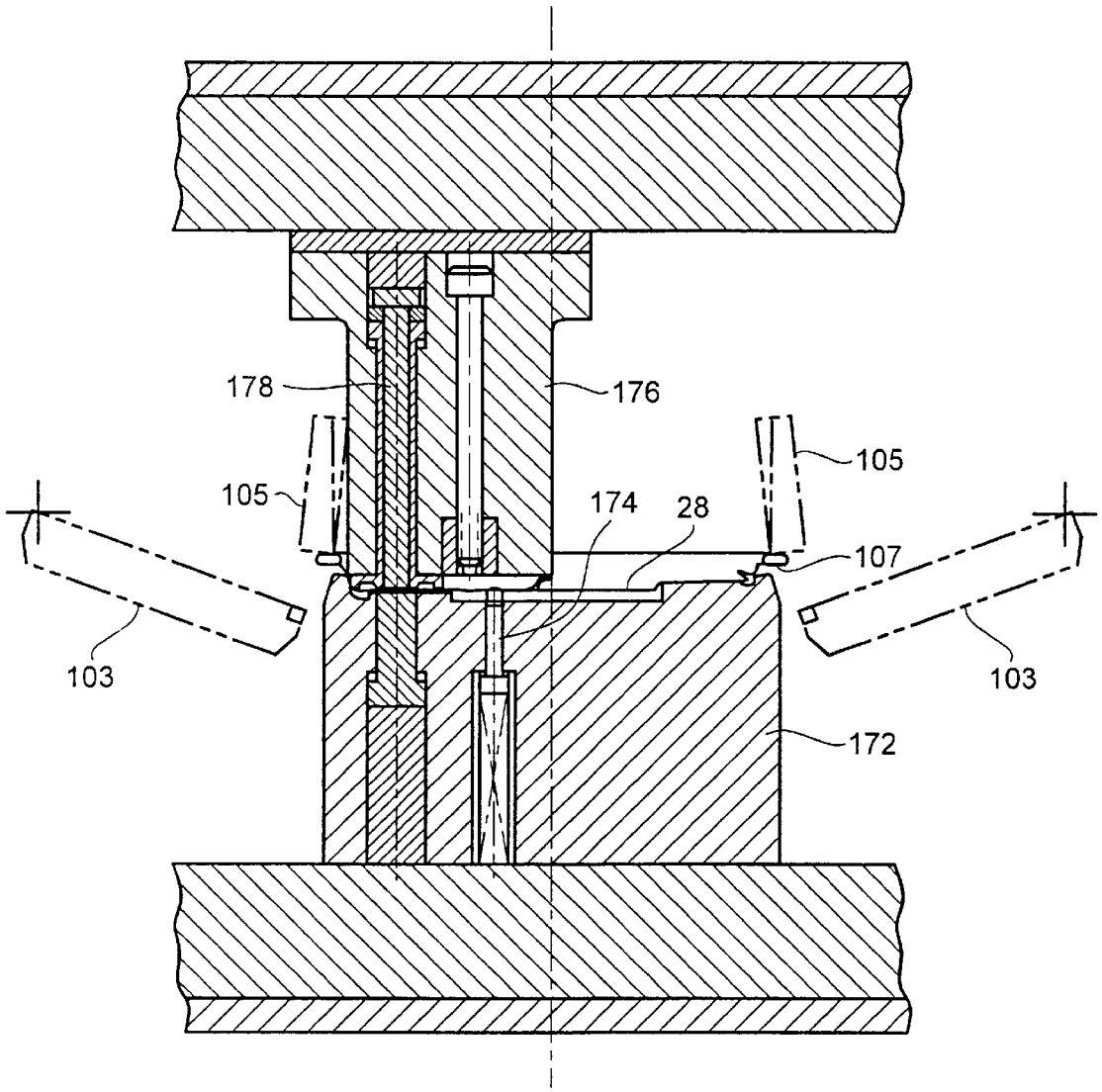
Figure 14A:
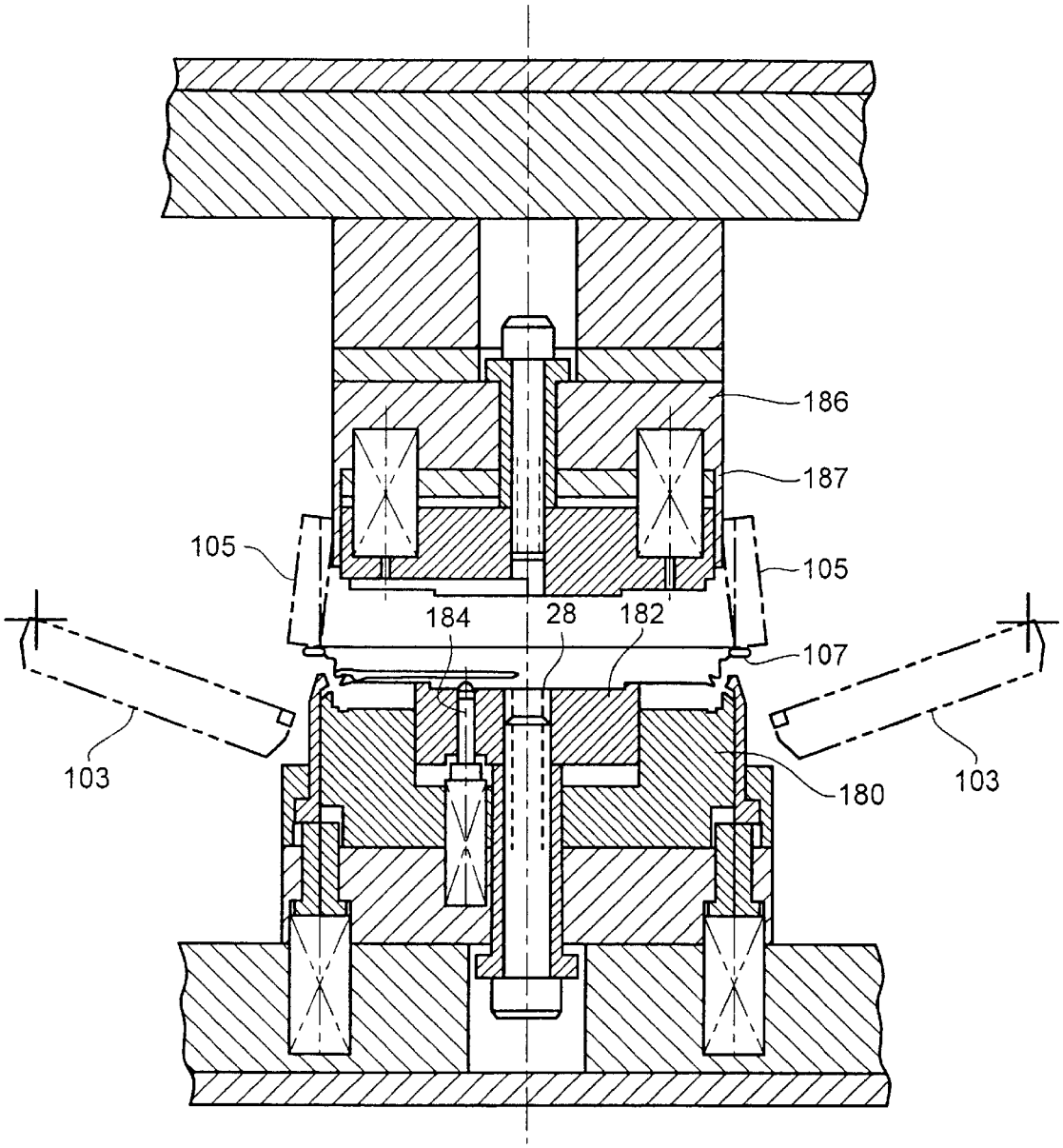
Figure 14B:
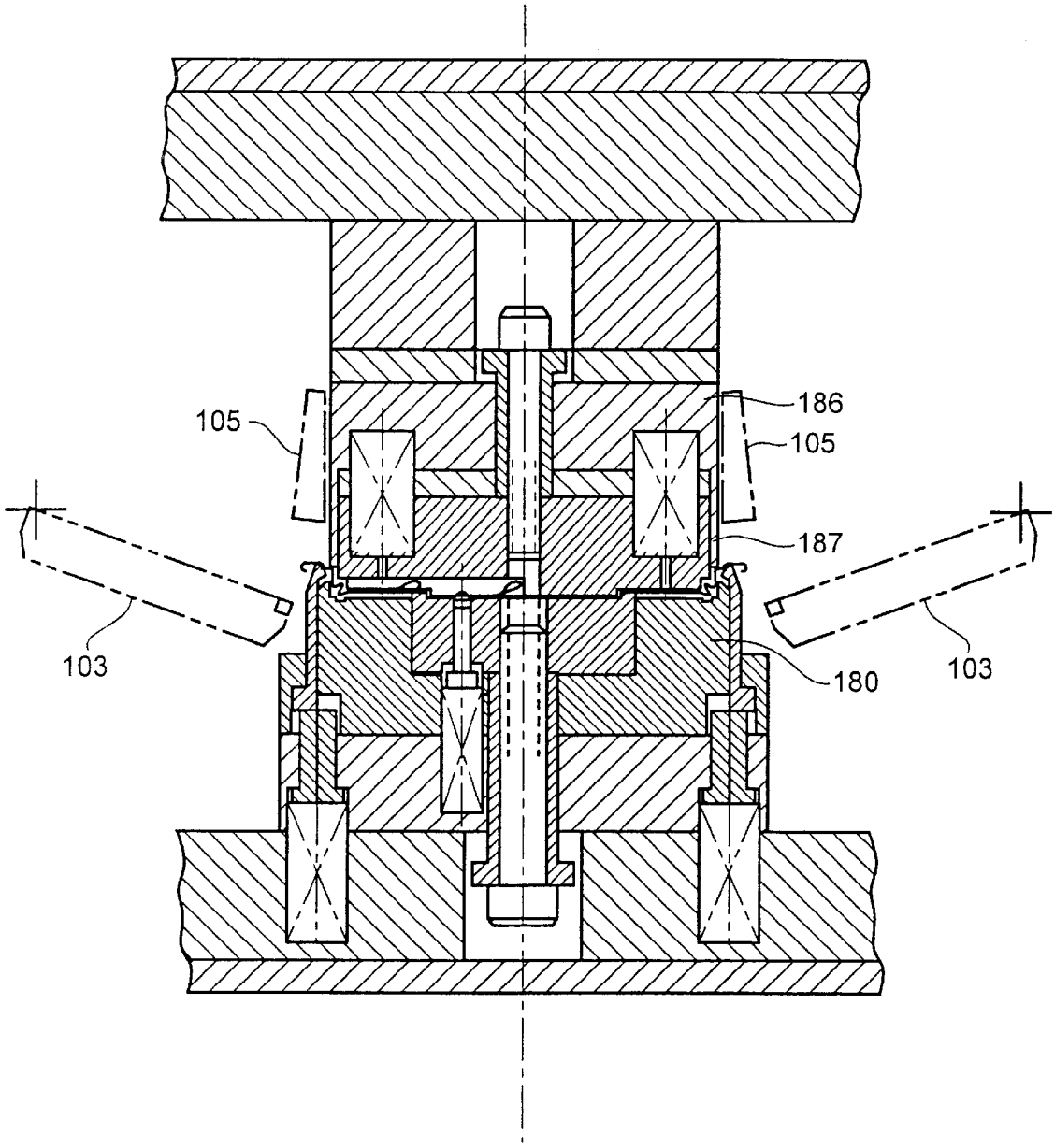
Figure 14C:
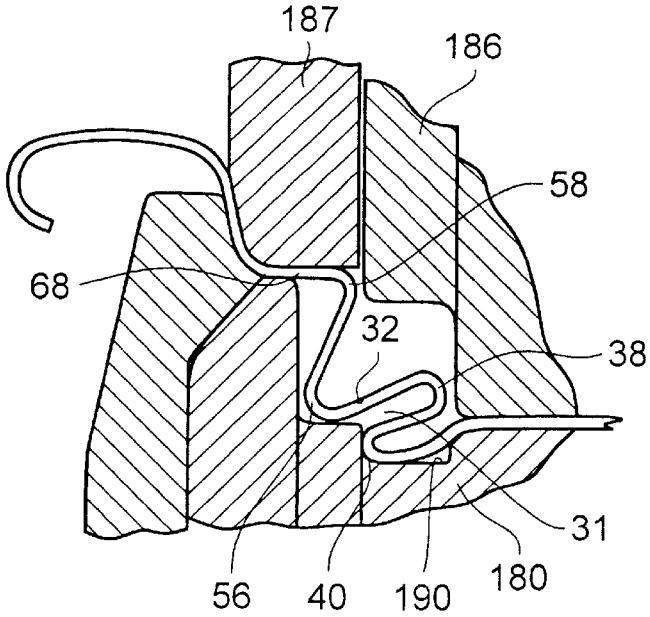
Figure 14D:
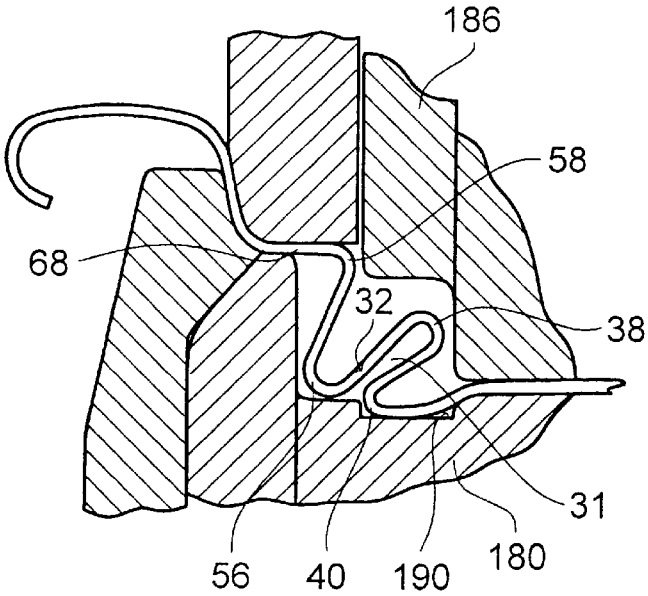
Figure 15:
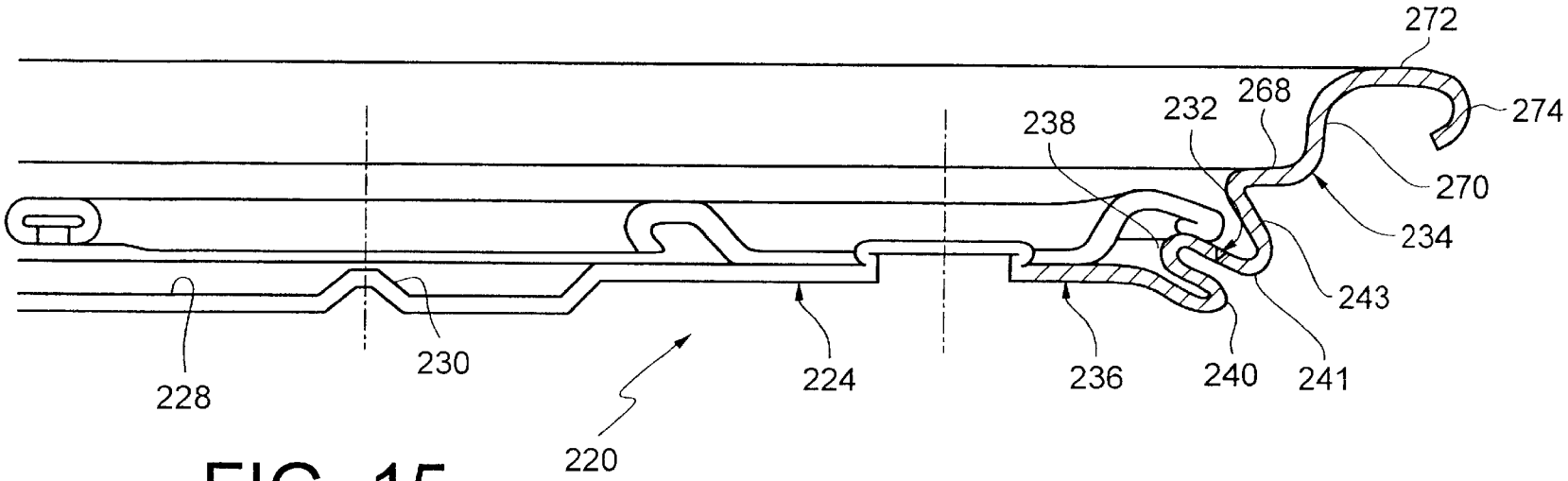
Figure 16:
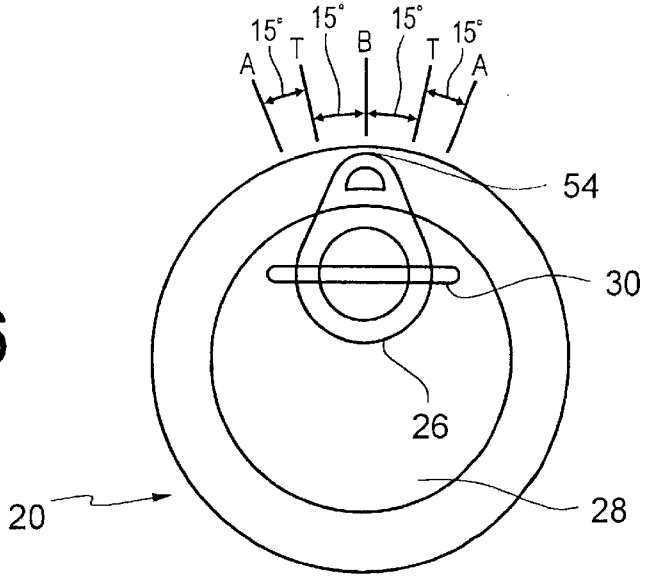

FIG. 4 cross-sectional view showing the way in which the container end closure is secured to a container;

FIG. 5 is a side view of a portion of the can end closure as seen from the line V—V in FIG. 2;

FIG. 6 is an enlarged cross-sectional view of the portion of the can end closure located on either side of the score line;

FIG. 7 is a bottom view of a portion of the can end closure with the opening tab pivoted upwardly;

FIG. 8 is a cross-sectional view of a portion of the shell press which forms the drawn shell that is used to fabricate the container end closure according to the present invention;

FIG. 9A is a cross-sectional view of the first stage in the conversion press used to fabricate the container end closure according to the present invention, wherein the upper die part is shown in the upward position prior to press bending;

FIG. 9B is a cross-sectional view similar to FIG. 9A after the upper die part has been moved downwardly;

FIG. 9C is a greatly enlarged cross-sectional view of a portion of the first stage of the press bender illustrated in FIG. 9B;

FIG. 10A is a cross-sectional view of the second stage of the press bender with the upper die part in the upward position prior to press bending;

FIG. 10B is an enlarged cross-sectional view of a portion of the press bender illustrated in FIG. 10A after the upper die part has moved downwardly;

FIG. 11A is a cross-sectional view of the third stage in the press bender, with the upper die part in the upward position prior to press bending;

FIG. 11B is an enlarged cross-sectional view of a portion of the press bender illustrated in FIG. 11A after the upper die part has moved downwardly;

FIG. 11C is an enlarged view of the score former and anvil shown in FIG. 11B, illustrating the way in which the V-shaped score line is formed;

FIG. 12A is a cross-sectional view of the fourth stage of the press bender, with the upper die part in the upward position prior to press bending;

FIG. 12B is an enlarged cross-sectional view of a portion of the press bender shown in FIG. 12A after the upper die part has moved downwardly;

FIG. 13 is a cross-sectional view of the fifth stage of the press bender illustrating the upper die part in the downward position;

FIG. 14A is a cross-sectional view of the sixth stage of the press bender with the upper die part in the upward position prior to press bending;

FIG. 14B is a cross-sectional view similar to FIG. 14A after the upper die part has moved downwardly;

FIG. 14C is an enlarged cross-sectional view of a portion of the fifth stage of the press bender illustrated in FIG. 14B in the region of the nose of the opening tab;

FIG. 14D an enlarged cross-sectional view similar to FIG. 14C, but taken along a different portion of the circumference of the press bender;

FIG. 15 is a cross-sectional view of one-half of a container end closure according to another embodiment of the present invention; and FIG. 16 is a top plan view of the container end closure showing the region of increased nose spread.

DETAILED DESCRIPTION OF THE PREFERRED EMBODIMENTS

Figure 1:
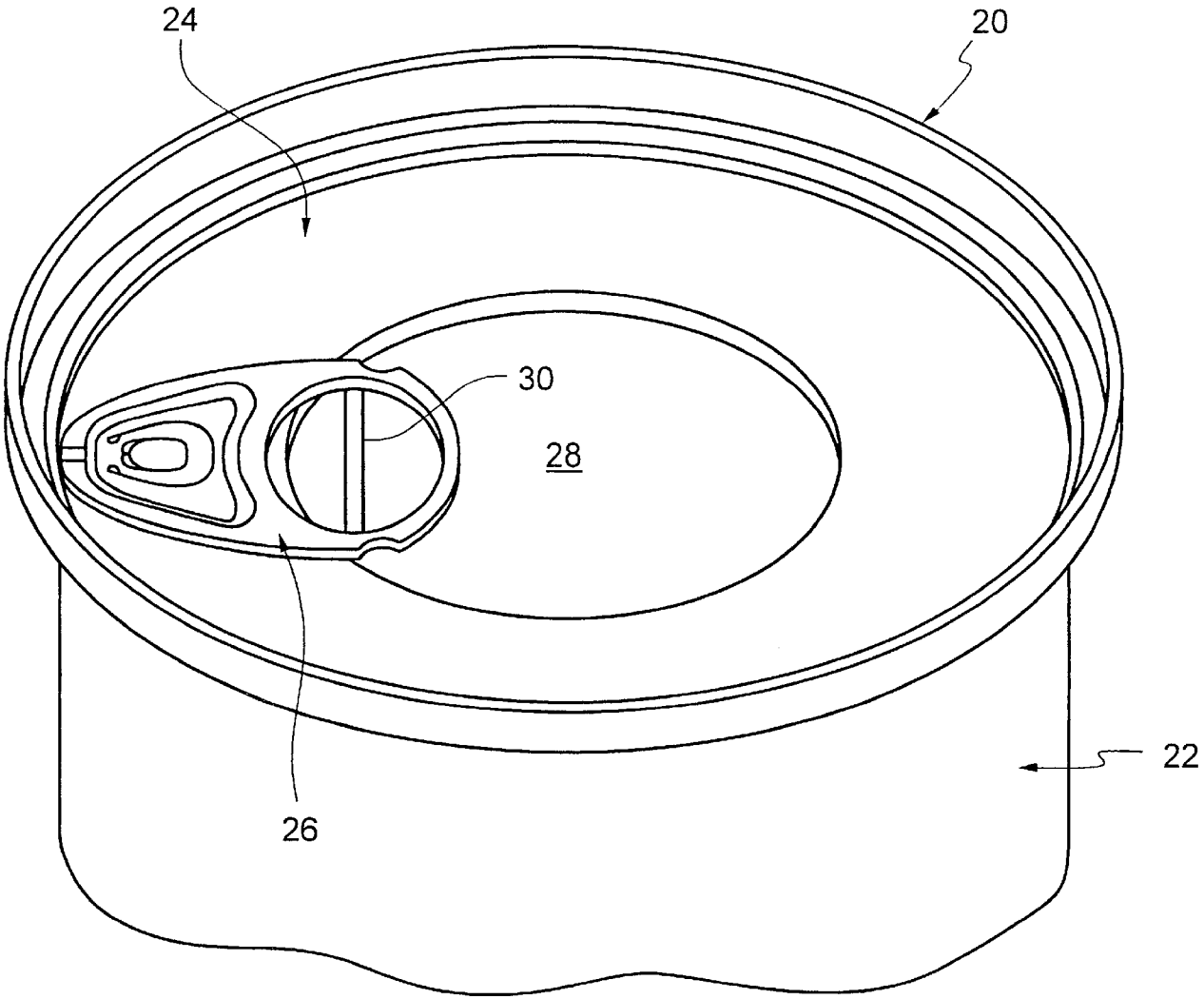

With reference initially to FIG. 1, the container end closure 20 of the present invention is adapted to be mounted on and secured to the open upper end of a container 22, the upper portion of which is illustrated in FIG. 1. The container end closure 20 includes a lid 24 and an opening tab 26.

As illustrated in FIG. 1, the lid 24 is provided with a centrally located recessed portion 28 and a linear raised ridge or protuberance 30. In the finished product, the finger engaging portion of the opening tab 26 rests on the ridge 30 so that the finger engaging portion of the opening tab is spaced from the surface of the lid 24. The combination of the ridge 30 and the recessed portion 28 provides a space between the finger engaging portion of the opening tab 26 and the surface of the lid 24 that facilitates an individual's ability to grasp the finger engaging portion of the opening tab 26. In addition, as described in more detail below, the central recessed portion 28 and the linear ridge 30 perform an important function during fabrication of the container end closure in that they assist in orienting and properly positioning the container end closure.

As seen with reference to FIG. 2 which is a cross-sectional view of the container end closure according to the present invention, the lid 24 of the container end closure 20 includes a score line 32 that extends around the entire circumference of the lid 24. Details relating to the score line 32 will be better understood with reference to the description below and the illustrations in various other drawing figures. The portion of the lid 24 that is located outwardly of or contiguous with the outer side of the tear line 32 is referred to as the peripheral lid portion 34 while the portion of the lid 24 located inwardly of or contiguous with the inner side of the score line 32 is referred to as the central lid portion 36.

Generally speaking, beginning at the score line 32, the central lid portion 36 defines an intermediate fold 38 that opens outwardly and an underlying bottom fold 40 that opens inwardly. The bottom fold 40 merges into a center panel portion 41 of the central lid portion that extends across the upper end of the container.

Further details relating to the configuration of the central lid portion are better seen with respect to the enlarged cross-sectional view illustrated in FIG. 3. As seen in FIG. 3, the central lid portion 36 progressively defines, in cross section, extending inwardly from the score line 32 towards the center of the central lid portion an upwardly and inwardly extending first portion 42 that merges into an outwardly turning loop portion 44, a downwardly and outwardly extending second portion 46 that merges into an inwardly turning loop portion 48 which then merges into an upwardly and inwardly extending third portion 50.

Referring back to FIG. 2, the upwardly and inwardly extending third portion 50 merges into the generally flat planar central panel portion 41 of the lid located at the center of the central lid portion 36. The opening tab 26 is secured to the central lid portion 36 by way of a flattened boss or rivet 52. The rivet 52 extends upwardly from the bottom panel portion 41. As can be seen with reference to FIG. 2, the opening tab 26 is positioned so that the nose 54 of the opening tab 26 is positioned adjacent the score line 32.

As mentioned above, the portion of the lid 24 located outwardly of or contiguous with the outer side of the score line 32 is referred to as the peripheral lid portion 34. Generally speaking, beginning at the score line 32, this peripheral lid portion 34 is defined by an intermediate fold 56 that opens inwardly and a top fold 58 that opens outwardly.

Turning to the enlarged cross-sectional view illustrated in FIG. 3, the peripheral lid portion 34 progressively defines, in cross section, from the score line 32 outwardly towards the outermost periphery, a downwardly and outwardly extending first portion 60 merging into an inwardly turning loop portion 62, an upwardly and inwardly extending second portion 64 extending from the inwardly turning loop portion 62, an outwardly turning loop portion 66 extending from the upwardly and inwardly extending second portion 64, and a generally horizontally extending third portion or ledge 68 extending from the outwardly turning loop portion 66. The horizontal ledge 68 forms the upper leg of the top fold 58. From the horizontal ledge 68, the peripheral lid portion 34 includes a vertically extending portion 70 that merges into an outwardly curved portion 72 terminating in a curled end 74. When the container end closure 20 is secured to the container such as illustrated in FIG. 4, the vertically extending portion 70 of the peripheral lid portion 34 will be disposed along the interior surface of the upper end of the container while the outwardly curving portion 72 will extend up over the end of the container and back down the outer edge of the container to form a bead.

As can be seen from FIGS. 2 and 3, the bottom fold 40 (i.e., the inwardly turning loop portion 48) extends radially outwardly beyond the score line 32. That is, the bottom fold 40 extends radially outwardly beyond a vertical line passing through the score line 32. In addition, the top fold 58 (i.e., the outwardly turning loop portion 66) extends radially inwardly beyond the score line 32. That is, the top fold 58 extends radially inwardly beyond a vertical line passing through the score line 32. The purpose for this particular arrangement is to ensure that when the central lid, portion 36 is separated and removed from the peripheral lid portion 34 remaining on the container at the time of opening the container end closure, the sharp edge on the removed central lid portion 36 and the sharp edge on the remaining peripheral lid portion 34 are protected and safe from injurious contact with an individual.

To effect opening of the container end closure for purposes of removing the contents from the container on which the container end closure is mounted, the finger engaging portion of the opening tab 26 is pivoted upwardly about the rivet 52. This causes the nose 54 of the opening tab to move downwardly and press against the score line 32. The nose 54 of the opening tab 26 severs the score line along an arc constituting a portion of the entire circumferential extent of the score line 32. The opening tab 26 is then pulled upwardly to complete the severing of the score line 32 so that the central lid portion 36 is separated and removed from the peripheral lid portion 34. The central lid portion 36 that has been removed from the peripheral lid portion 34 remaining on the container possesses a sharp edge at the severed edge previously forming a portion of the score line. Because the bottom fold 40 (i.e., the inwardly turning loop portion 48) extends radially outwardly beyond the severed edge previously forming a part of the score line 32, individuals are not liable to cut themselves on the severed edge because the bottom fold 40 extends radially outwardly beyond the severed edge. Similarly, in the case of the severed edge on the peripheral lid portion 34 remaining on the container, the top fold 58 (i.e., the outwardly turning loop portion 66) extends radially inwardly beyond the severed edge previously forming a part of the score line 32. Thus, individuals are once again not liable to become injured by the sharp severed edge as the overlying portion of the peripheral lid portion formed by the top fold 58 inhibits direct contact with the severed edge.

One particularly advantageous aspect of the present invention involves the configuration of the score line 32. As shown in more detail in FIG. 6, the score line 32 is in the form of a groove. In the illustrated embodiment, the score line is a V-shaped groove with a radiused or rounded nose 32'. In addition, a small radiused or rounded surface is formed on the side of the material forming the lid that is opposite to the score-line 32 (i.e., on surface 35). This radiused or rounded surface 33 is disposed in opposition to the rounded nose 32' of the V-shaped score line. There are several advantages associated with the use of the V-shaped score line 32.

First, the residual material remaining in the region of the score line as represented by the dimension X in FIG. 6 is less than would be the case if, instead of a grooved score line, a tear line formed by drawing the side wall of the lid was employed. The residual material remaining in the region of the V-shaped score line 32 constitutes the amount of material that must be severed in order to separate the central lid portion 36 from the peripheral lid portion 34. Thus, with a smaller amount of residual material in the area of the V-shaped score line 32, it is easier to sever the score line and ultimately separate the central lid portion from the peripheral lid portion. Further, the configuration of the V-shaped score line 32 provides a well defined line along which severance occurs. A tear line formed in a different manner such as by stretching the material forming the sidewall of the lid does not provide a well defined line along which severance occurs and so upon opening the lid the line of severance will tend to wander. This could detrimentally affect the safeness of the lid once the central lid portion is removed because a part of the sharp edge on the removed central lid portion or on the peripheral lid portion remaining on the container may no longer be sufficiently set back from the underlying/overlying fold that is supposed to protect the sharp edge.

It is also significant to note that the V-shaped score line 32 is not oriented perpendicular to the surface 33 of the portions of the end closure located on either side of the score line 32. Rather, the V-shaped score line 32 is inclined slightly from such a perpendicular orientation as will become more clear from the discussion below. This is advantageous as it makes the severing of score line easier during opening of the container end closure.

As will be described in more detail below, the use of a V-shaped score line also reduces the possibility that the coating applied to the inner surface 35 of the lid will become damaged and require subsequent repair. When forming the score line 32, it is desirable to displace as much material as possible so that the resulting residual material that must be severed to open the container end closure is as small as possible. However, the more material that is displaced, the more likely it is that the enamel coating will be adversely affected. The V-shaped score line 32 thus provides what has been found to be an ideal compromise between displacing as much material as possible to reduce the residual material as much as possible while at the same time not adversely affecting the enamel coating. Further, as will also be discussed in more detail below, the V-shaped score line prevents the formation of fractures. The integrity of the resulting lid is thus not adversely affected.

Another particularly advantageous aspect associated with the present invention can be seen initially with reference to FIG. 2. As shown in FIG. 2, in the region of the nose of the opening tab 26, a gap 31 is disposed below the score line 32. This gap 31 is referred to as the nose spread and extends around the entire circumference of the lid. The nose spread 31 generally corresponds to the degree of opening defined by the first loop 38. This nose spread 31 also represents the distance through which the upwardly and inwardly extending first portion 42 of the central lid portion 36 can move before contacting the underlying downwardly and outwardly extending second portion 46 of the central lid portion 36 upon severing the score line 32. In the region of the nose 54 of the opening tab 26, the nose spread possesses a dimension represented by Y in FIG. 2 whereas on the diametrically opposite side of the lid 24, the dimension of the nose spread represented by Y' in FIG. 2 is significantly less. The reason for providing a larger nose spread 31 in the region of the opening tab nose 54 and a smaller nose spread in other areas of the lid around the circumference is as follows.

When the opening tab 26 is pivoted upwardly, the nose 54 of the opening tab 26 presses down on the upwardly and inwardly extending first portion 42 of the central lid portion 36. This downward force causes the score line 32 to rupture or break. As the opening tab 26 is further pivoted upwardly, the severing of the score line 32 propagates outwardly from the point at which the nose 54 of the opening tab is located. Additionally, as the opening tab 26 is further pivoted upwardly, the upwardly and inwardly extending first portion 42 of the central lid portion 36 moves closer and closer towards the downwardly and outwardly extending second portion 46 of the central lid portion 36 that underlies the upwardly and inwardly extending first portion 42, until such time as the upwardly and inwardly extending first portion 42 contacts the downwardly and outwardly extending second portion 46. Once the upwardly and inwardly extending first portion 42 of the central lid portion 36 contacts the underlying downwardly and outwardly extending second portion 46, further movement of the severed portion of the upwardly and inwardly extending first portion 42 is resisted by the downwardly and outwardly extending second portion 46. It can thus be seen that as the dimension of the nose spread 31 is reduced, the distance through which the severed upwardly and inwardly extending first portion 42 is able to move before contacting the underlying downwardly and outwardly extending second portion 46 is also reduced. Because the distance over which the severed portion of the upwardly and inwardly extending first portion 42 is able to move during upward pivoting movement of the opening tab 26 controls the circumferential extent along which the score line 32 is broken, the smaller the distance over which the severed part of the upwardly and inwardly extending first portion 42 can move before contacting the underlying downwardly and outwardly extending second portion 46 reduces the circumferential extent to which the score line 32 is severed through upward pivoting movement of the opening tab 26.

On the other hand, as the dimension of the nose spread 31 is increased, the safe appearance of the product becomes diminished because the sharp severed edge of the upwardly and inwardly extending first portion 42 is located farther away from the underlying downwardly and outwardly extending second portion 46. Also, as the dimension Y of the nose spread 31 is increased, there exists the possibility that an individual might inadvertently contact the sharp severed edge of the central lid portion 36, once again because the sharp severed edge is spaced from the underlying downwardly and outwardly extending second portion 46 by a greater distance.

In accordance with the present invention, the lid 24 is constructed so that the dimension Y of the nose spread 31 is increased along only a short circumferential extent on either side of the position where the nose 54 of the opening tab 26 is located. This is represented by the FIG. 5 illustration.

Point B in FIG. 5 represents the location of the nose 54 of the opening tab 26. On either side of this point B, the nose spread 31 underlying the score line 32 possesses an increased dimension. The nose spread is gradually reduced in dimension through a transition zone until it reaches the points designated A in FIG. 5 where the dimension of the nose spread 31 is equal to the dimension Y' shown in the FIG. 2. Thus, in accordance with the present invention, a relatively large nose spread is provided at the position where the nose 54 of the opening tab 26 is located and this nose spread of increased dimension extends on opposite sides of the point B. The size of the nose spread 31 is then gradually reduced through a transition zone until reaching points A at which the dimension of the nose spread 31 is represented by the dimension Y' shown in FIG. 2. By virtue of this construction, the lid is provided with an enlarged nose spread 31 over the region where the score line 32 is initially severed as a result of the upward pivoting movement of the opening tab 26. Thus, when the opening tab 26 is pivoted vertically upright, the score line 32 is severed along an arc extending between the two points designated A in FIG. 5 to thus define a severed chordal length L as illustrated in FIG. 7. The arc between points A and A (i.e., the arc along which the nose spread is increased and then transitions to the nose spread around the remainder of the circumference) can be on the order of 60°. More particularly, the nose spread is increased a generally constant amount along an arc of 15° on either side of the center of the nose spread location and then transitions along an additional arc of 15° to the nose spread that exists. This is generally illustrated in FIG. 16 where the point B represents the center line of the nose 54 of the opening tab 26, the points T represents the beginning of the transition zone and the points A represent the end of the region of increased nose spread. Between point B and points T on either side the nose spread is increased and is generally constant. From each point T to the adjacent point A, the nose spread transitions from the increased nose spread to the nose spread that is present throughout the remainder of the circumference of the lid.

As mentioned above, as the dimension of the nose spread 31 is increased, the perceived safeness of the container end closure is reduced because the severed edge of the score line 32 on the removed central lid portion 36 is located farther away from the underlying downwardly and outwardly extending second portion 46. Further, the actual safeness of the removed central lid portion may be adversely affected. However, increasing the size of the nose spread 31 in the manner noted above does not raise such concerns. The reason is because the circumferential portion of the lid along which the size of the nose spread 31 is increased is located at the nose 54 of the opening tab 26 and on either side of the opening tab nose 54 by a small circumferential extent. The circumferential extent over which the nose spread 31 is increased generally corresponds to the arc along which the score line 32 is severed during upward pivoting movement of the opening tab 26. As the opening tab 26 is pivoted upwardly, the nose 54 of the opening tab not only severs the score line 32, but also presses the severed edge on the central lid portion 36 downwardly towards the underlying downwardly and outwardly extending second portion 46. Thus, while the nose gap 31 in the region extending a short distance on either side of the opening tab nose 54 gap is initially larger than the rest of the circumferential extent of the nose spread 31, once the upward pivoting movement of the opening tab 26 is completed, the nose spread 31 of increased dimension is actually reduced. Thus potential problems with respect to the severed edge on the removed central lid portion 36 being spaced too far from the underlying downwardly and outwardly extending second portion 46 do not arise.

A further advantageous aspect of the present invention involves the horizontally extending ledge or third portion 68 that is provided on the peripheral lid portion 34. This horizontal ledge 68 greatly facilitates the removal of process water used during the container closing process. This is because the horizontal orientation of the ledge 68 causes the space S shown in FIG. 3 to be configured with a wider opening than the inside. That is, the mouth of the space S is wider than at the vertex of the fold. Consequently, process water can be readily removed by an appropriate mechanism such as an air knife. The reason why the removal of such process water is important is that when the score line is formed, the metal in the score line becomes exposed (i.e., the enamel coating is removed) and thus represents a possible area of corrosion if water is present. Thus, being able to properly remove water in the space S is rather important. If the ledge was angled downwardly rather than being horizontal, the space would be much more narrow at the mouth and the ability to remove water in the space would be severely limited.

Another advantage associated with the horizontal ledge 68 is that it allows the container end closure to be opened either through manipulation of the opening tab 26 or through use of a can opener. It has been found that although the container enclosure of the present invention is designed to be opened through use of the opening tab 26, some individuals still prefer using a can opener. Thus, the provision of the horizontally extending ledge 68 makes possible this alternative opening operation.

The method of fabricating the container end closure according to the present invention is as follows. Flat sheets of metal are first cut from a coil and an enamel coating is then applied to both sides of the sheets. The metal can be, for example, aluminum, steel, laminated aluminum, or laminated steel (e.g., PET laminate over chromium coated steel). The metal sheets are then placed in a shell press such as that illustrated in FIG. 8 to form drawn shells, each of which is used to form a container end closure in accordance with the present invention.

As seen with reference to FIG. 8, the shell press includes a lower press member 100 and an upper press member 102. The lower press member 100 includes a bottom wall whose central portion is provided with a recess 104. The upper portion of the sidewall of the lower press member 100 is provided with a shoulder 106. As the upper press member 102 is moved downwardly into the lower press member 100, the circular disk is formed into a drawn shell having a bottom wall 108 and a sidewall 110. The central portion of the bottom wall 108 is pressed downwardly into the recess 104 to form the central recessed portion 28 that constitutes a part of the finished closure shown in FIG. 2. This central recessed portion 28 plays an important role in the subsequent fabrications steps.

The shoulder 106 on the sidewall of the lower press member 100 forms the initial stage of what will ultimately become the horizontal ledge 68 shown in FIG. 2. The shell press also imparts a partial curvature to the outer periphery of the drawn shell as seen in FIG. 8. Once the formation of the drawn shell is completed, the drawn shell is removed from the shell press. The outer periphery of the drawn shell is then subjected to a spin curler operation through use of curler tooling in order to inwardly curve the outermost periphery of the drawn shell to form the curled end 74 shown in FIG. 2.

The completed drawn shell with the spin curled outer periphery is then sent to a compound liner to apply a compound sealant on the underside of the outer periphery of the shell. This sealant facilitates proper sealing when the container end closure is put on a container. After application of the compound sealant, the drawn shell is placed in a conversion press for performing the fabrication steps required to produce the container end closure having the configuration illustrated in FIG. 2.

The conversion press preferably utilizes a high speed transfer mechanism for advancing individual drawn shells progressively through successive tooling stations of a transfer die such as they disclosed in U.S. Pat. No. 4,106,633. The first station in the conversion press is illustrated in FIGS. 9A, 9B, 9C. As seen with reference to FIG. 9A, the conversion press includes a pair of pivoting feed bars 103 and a pair of clamp bars 105. The feed bars 103 and the clamp bars 105 together advance the drawn shell from station to station in the conversion press. To move the shell from one station to the next, the feed bars 103 are adapted to pivot upwardly to engage the underside of the curled outer periphery of the drawn shell 107. The curled outer periphery of the drawn shell 107 is thus clamped between the feed bars 103 and the clamp bars 105. The clamp bars 105 and the feed bars 103 then move together to advance the dawn shell 107 to the next station. At the next station, the feed bars 103 pivot downwardly to release the drawn shell 107, and the feed bars 103 and clamp bars 105 then move back to pick up and move the next shell in succession. The conversion press operates to advance a series of shells from station to station in the conversion press. Thus, if the conversion press includes six stations, each of which is designed to perform a different part of the pressing operation, the conversion press operates so that the clamp bars 105 and the feed bars 103 grasp the shells located at the various stations, lift/clamp the shells, advance the shells to the next station and then release the shells at the next station. The feed bars 103 and the clamp bars 105 then move back to lift/clamp the shells and repeat the operation. In this way, each shell is advance in series from station to station within the conversion press. After the last station, the container end closure 20 shown in FIG. 2 emerges from the press.

Referring to FIG. 9A, the drawn shell 107 is released by the feed bars 103 at a first position where the drawn shell 107 is positioned on the top surface of a lower die part 112 which is spring-biased upwardly. The lower die part 112 includes a recessed area that receives the recessed portion 28 in the drawn shell. The recessed portion 28 of the drawn shell 107 serves as a locating mechanism for properly positioning the drawn shell 107 in the first station of the conversion press. The shell is thus prevented from moving radially (i.e., side-to-side). A bead punch 114 and a rivet-formed punch 116 are provided in the lower die part 112.

In this first station, an upper die part 118 is adapted to be moved downwardly towards the lower die part 112. The upper die part 118 moves downwardly into contact with the lower die part 112 and forces the lower die part 112 downwardly in opposition to the upward biasing force. This causes the bead punch 114 to extend upwardly beyond the upper surface of the lower die part 112 to thereby form a linear bead or ridge in the bottom wall of the shell. This linear bead or ridge corresponds to the linear ridge 30 illustrated in FIGS. 1 and 2. In addition, the rivet form punch 116 is forced upwardly beyond the upper surface of the lower die part 112 to thereby form the initial stages of the rivet form 52 shown in FIG. 2 that is ultimately used to secure the opening tab to the container end closure. The formation of the linear ridge 30 and the initial configuration of the rivet form 52 in this first stage of the pressing operation is highly advantageous. The conversion press is designed to operate at rather high speeds and so the shells 107 are transferred from one station to the next rather quickly. Further, as will become apparent from the description below describing the various fabrication steps, proper positioning and orientation of the shell at each stage is important to ensure accurate fabrication of the shell. The linear bead 30 and the rivet form 52, in conjunction with the previously formed recessed portion 28, are used in all subsequent stations to ensure proper positioning and orientation of the shell at each station.

As illustrated in more detail in the enlarged cross-section shown in FIG. 9C, this first pressing step results in the formation of a second step in the sidewall 100 of the shell 107 by virtue of a shoulder 120 provided in the lower die part. This step in the sidewall 110 of the shell represents the initial stages of what ultimately is the intermediate fold 38 of the central lid portion 36 shown in FIG. 2.

The drawn shell possessing two steps in the sidewall is then transferred by the feed bars 103 and the clamp bars 105 from the first station to a second station illustrated in FIGS. 10A and 10B. In this second station, the bottom fold 40 of the central lid portion 36 shown in FIG. 2 is formed and the formation of the intermediate fold 38 shown in FIG. 2 which was begun in the first station proceeds further. In addition, the very initial stages of forming the intermediate fold 56 and the top fold 58 of the peripheral lid portion 34 shown in FIG. 2 are begun.

The shell 107 transferred from the first station to the second station is positioned on a spring biased centrally located support 122 as shown in FIG. 10A. This support 122 includes a centrally located recess that receives the recessed portion 28 in the shell, thus ensuring proper positioning of the shell within the second station of the conversion press. As the shell 107 is released by the feed bars 103 and falls onto the support 122, proper orientation of the shell 107 is ensured by virtue of the bead punch 124 that extends through the support 122 and engages the previously formed linear ridge 30.

The spring biased support 122 is positioned within a lower die part 128 and a rivet form punch 126 extends through the support 122 for engaging the previously started rivet form 52. The rivet form punch 126, which is slightly smaller in diameter than the rivet form punch used in the first station, is provided in the lower die part 128. In this second station, an upper die part 130 is adapted to move downwardly. A rivet shaping element 132 provided in the upper die 130 receives the rivet form punch 126 to thereby further form the rivet 52 that is ultimately used to secure the opening tab to the lid.

As seen with reference to FIG. 10B, the lower die part 128 is provided with an annular recess 134. This annular recess 134 receives the lower end of the shell 107 to begin formation of the bottom fold 40 of the central lid portion 36 shown in FIG. 2. In addition, the annular recess 134 causes the formation of a slightly raised central panel which imparts additional strength to the shell and helps support the bottom fold during formation. As also illustrated in FIG. 10B, the upper die part 130 is provided with a series of steps for maintaining formation of the horizontal ledge 68 formed during the shell tooling and to effect further folding of the intermediate fold 38 of the central lid portion 36. It can also be seen with reference to FIG. 10B that in this second station, the vertical portion 110' of the shell sidewall is bowed outwardly slightly to just begin the initial formation of the upper fold 58 of the peripheral lid portion 34 shown in FIG. 2. This slight inward bowing of the vertical upper portion 110' of the sidewall is achieved by configuring the lower die part so that the upper vertical wall 129 is slightly shorter than the corresponding potion of the wall in the first station.

After the second stage of the pressing operation shown in FIGS. 10A and 10B is completed, the upper die part 130 is raised and the shell 107 is advanced to the third station shown in FIGS. 11A and 11B by the feed bars 103 and clamp bars 105. In this third station, the score line 32 is formed in the shell 107. In addition, the top fold 58 of the peripheral lid portion 34 is further formed at this station and substantially final formation of the rivet form 52 is achieved.

As seen initially with reference to FIG. 11A, the third stage once again includes a spring biased support 136 for supporting the shell 107. This support 136 is mounted in a lower die part 140 and is provided with a recess that receives the recessed portion 28 in the bottom wall of the shell. A bead punch 138 extends through the support 136 and slightly above the upper surface of the support to engage the previously formed linear bead 30 at the time the shell 107 is released by the feed bars 103 and falls onto the support 136.

Thus, the combination of the recessed portion 28 and the ridge 30 on the shell once again ensures that the shell 107 is properly oriented and properly positioned. The lower die part 140 also receives a rivet form punch 142 that is slightly smaller in outer diameter than the rivet form punch used in the prior station.

A movable upper die part 144 is adapted to be moved downwardly towards the lower die part 140. A rivet shaping element 146 is mounted in the upper die element 144 and is adapted to engage the rivet form punch 142 during downward movement of the upper die 144 to further configure to substantially its final configuration the rivet 52 that will be used in a subsequent station for securing the opening tab to the lid.

As seen in more detail in FIG. 11B, the lower die part 140 includes a spring loaded element 148 possessing a shoulder that further forms the horizontal ledge 68 into a more horizontal orientation. The spring loaded nature of the element 148 facilitates removal of the shell after completion of the pressing operation in the third station.

The upper die part 144 includes a shoulder 152 at which is provided a V-shaped score former 154 for forming the score line 32 shown in FIG. 2. The lower die part 140 includes an anvil 156 that is positioned in opposition to the score former 154 during formation of the score line. Details relating to the score former 154 and the anvil 156 are better seen with reference to the enlarged cross-sectional view of FIG. 11C.

As seen in FIG. 11C, the score former 154 is V-shaped and has a radiused or rounded nose 158. When the score former 154 is pressed into the material forming the shell, a score line having a configuration that is the mirror image of the score former 154 is formed. That is, the resulting score line is V-shaped and possesses a radiused or rounded vertex as previously described in connection with the illustration in FIG. 3. As can be seen with reference to FIG. 11B, the region of the shell sidewall at which the score line is formed is angled upwardly at the time the score line is formed. FIG. 11C shows in detail the arrangement of the score former 154 and the anvil 154 relative to the sidewall of the lid during formation of the score line. As can be seen, the portion of the lid in which the score line is formed is inclined at an angle P which can vary in small respects, but is typically on the order of about 12°. Thus, the penetration of the score former 154 into the metal on one side of the score former is different from that on the other side. This si shown in FIG. 11C where the penetration length $L_1$ is less than the penetration length $L_2$. The Resulting V-shaped score line possesses sides having the corresponding lengths $L_1$ and $L_2$, where $L_1$ is less than $L_2$. Forming the V-shaped score line with the score former 154 being non-perpendicular to the side 35 of the material so as to form unequal penetration legs $L_1$, $L_2$ is quite advantageous as the resulting score line is more easily severed. FIG. 11C also illustrates the rounded nose 158 on the score former having a radius $R_1$.

The anvil 156 includes a radiused or rounded surface 160 having a radius $R_2$ that acts in opposition to the score former 154 during the pressing operation. During the pressing step, a rounded or radiused surface 33 is formed on the side 35 of the metal, with $L_4$ being less than $L_3$ as shown in FIG. 11C.

The V-shaped outline of the score former 154, the rounded or radiused configuration of the nose 158 of the score former 154, and the radiused or rounded surface 160 provided on the anvil 156 are significant in several respects. As described below, fabrication steps after the third station (i.e., after the score line 32 is formed) cause the material in the area of the score line 32 to be subjected to various bending forces. By configuring the score former 154 in a way that produces a score line in the form of a V-shaped groove, the score line 32 is readily able to spread open and spread closed during these subsequent fabrication steps. Additionally, as noted above, this shape of the score line makes it possible to displace a significant amount of material, thus reducing the residual material that must be severed to remove the central lid portion 36, while at the same time not creating stresses so significant as to cause the enamel coating to become damaged. Also, by providing a radiused or rounded nose 158 on the score former 154, the resulting score line possesses a radiused or rounded vertex, thus avoiding sharp corners which would be susceptible to fracture when the score line is spread closed and then spread back open in the subsequent fabrication steps.

Further, the radiused or rounded surface 160 on the anvil 156 helps protect the enamel coating on the shell when the score former 154 is pressed against the shell. With a flat surface 160 on the anvil 156, for example, the enamel coating would become damaged during the score line formation step. The rounded or radiused surface 160 on the anvil 156 functions almost like a clamp on the enamel coated side of the shell, thereby preventing the enamel coating from moving outwardly during the score formation step.

In this third station, the top fold 58 on the peripheral lid portion 34 is further formed by being moved inwardly as seen in FIG. 11B. Also, the ledge 68 begins to take on more of a horizontal orientation.

Once the pressing at the third station is completed, the upper die part 144 is lifted and the shell 107 is advanced to the fourth station shown in FIGS. 12A and 12B by way of the feed bars 103 and feed clamps 105. In this fourth station, further folding of the bottom fold 40 of the central lid portion 36 is effected and folding of the intermediate fold 38 of the central lid portion 36 proceeds.

As seen with reference to FIG. 12A, a lower die part 158 houses a spring biased support 160 that supports the shell 107. The support 160 is provided with a recess that receives the recessed portion of the shell 107 to ensure proper positioning of the shell 107. A bead punch 162 extends through the support 160 and extends into the previously formed ridge 30 to ensure that when the shell 107 is released by the feed bars 103, the shell 107 is properly oriented. A rivet forming punch 164 is also provided in the lower die part 158.

A downwardly movable upper die part 166 includes a spring loaded central element 168. The portion of the upper die part 166 surrounding the spring biased central element 168 possesses an inclined surface 170 to facilitate further folding of the bottom fold 40 as well as folding of the intermediate fold 38.

As illustrated in FIG. 12B, when the upper die part 166 is moved downwardly, the further folding of the bottom fold 40 is effected and the folding of the intermediate fold 38 of the central lid portion 36 is advanced. By virtue of the inclined surface 170 on the upper die part 166, which is inclined at an angle of about 30° from the horizontal, the portion of the bottom fold underlying the score line is moved upwardly, thus causing the score line 32 to partially close. As noted above, because the score line 32 is configured as a V-shaped groove, upward movement of the portion of the bottom fold 40 underlying the score line 32 is permitted. Further, because the nose of the score line 32 is rounded or radiused, this partial closing of the score line 32 does not result in fractures.

Once the fourth step illustrated in FIGS. 12A and 12B is completed, the upper die part 166 is lifted and the shell is then advanced to the fifth step illustrated in FIG. 13 by the feed bars 103 and the clamp bars 105. In this fifth step, the opening tab 26 is placed on the previously formed rivet 52 and the head of the rivet 52 is then flattened.

With reference to FIG. 13, a lower die part 172 is once again provided with a recess for receiving the recessed portion of the shell to provide proper positioning of the shell 107. A bead punch 174 is also provided to engage the previously formed linear bead in the shell to thereby provide proper orientation of the shell 107.

An upper die part 176 is movable towards the lower die part 172 and includes a rivet flattener 178. Once the opening tab is positioned on the previously formed rivet, the upper die part 176 moves downwardly and the rivet flattener 178 engages and flattens the rivet to thereby secure the opening tab in place. Once the rivet 52 has been flattened, the upper die part 176 is raised and the shell 107 is advanced to the sixth and final station illustrated in FIGS. 14A, 14B, 14C, 14D by the feed bars 103 and the clamp bars 105.

As illustrated in FIG. 14A, a lower die part 180 includes a spring biased support 182 for supporting the shell 107. A bead punch 184 extends through the support 182 and engages the previously formed linear bead to once again ensure proper orientation of the shell 107. A recess is also provided in the support 182 for receiving the recessed center portion 28 of the shell 107 to thereby ensure proper positioning of the shell 107. An upper die part 186 is adapted to be moved downwardly towards the lower die part 180, and a surrounding pressing element 187 is movable relative to the upper die part 186.

FIGS. 14B and 14C illustrate the upper die part 186 and the pressing element 187 in the lowered position. FIG. 14C illustrates the configuration of the lid in the general region of the nose 54 of the opening tab 26 (i.e., in the area between points A and A in FIG. 5) after completion of the last pressing step. The illustration in FIG. 14C is taken just to the side of the opening tab 26 for purposes of ease in understanding, and so the opening tab 26 is not shown in FIG. 14C. FIG. 14D illustrates the configuration of the lid in the area outside the region between points A and A in FIG. 5 after completion of the last pressing step.

As can be seen from a comparison of FIG. 14C to FIG. 14D, by virtue of the force applied by the upper die part 186 to the opening tab 26 in the last pressing step, in the region between points A and A in FIG. 5, the bottom fold 40 is closed slightly, and the intermediate fold 38 of the central lid portion 36 is urged downwardly a small amount. The upper die part 186 presses against the opening tab to cause the nose spread 31 underlying the score line 32 to open up. This produces the configuration described above and illustrated in FIG. 5 where the nose spread 31 underlying the score line 32 is of greater dimension at the point where the nose 54 of the opening tab 26 is located (i.e., the point B in FIG. 5), and in limited regions on either side of the nose 54 of the opening tab 26 (i.e., between point B and point A on either side), than in the other regions of the nose spread 31 extending along the circumferential extent of the lid.

The way in which the nose spread is increased in this region is by increasing the depth of the groove part 190 shown in FIGS. 14C and 14D. As can be seen from a comparison of FIGS. 14C and 14D, the groove part 190 is deeper in the area where the nose spread is to be increased (FIG. 14C) than it is in the remaining circumferential extent of the central lid portion (FIG. 14D). Thus, when the upper die part 186 presses against the opening tab 26, the groove part 190 of greater depth permits the nose spread to open up whereas the groove part 190 that is not of greater depth does not permit the nose spread to be enlarged. This thus provides a greater nose spread between points A and A in FIGS. 5 and 16. This is why the nose spread 31 is increased or opened up only in the limited region defined between the points A and A in FIG. 5.

As mentioned above, there also exists a transition region at which the increased nose spread transitions to the nose spread that exists throughout the remainder of the circumferential extent of the lid. This transition region is formed by gradually tapering or transitioning the depth of the groove part 190 from that shown in FIG. 14C to that shown in FIG. 14D. Thus, with reference to FIG. 16, to form the nose spread between point B and point T on either side, the depth of the groove part 190 is constant and is that shown in FIG. 14C. Between each point T, where the transition begins, and the adjacent point A, the depth of the groove part 190 gradually decreases from that shown in FIG. 14C to that shown in FIG. 14D.

In addition, a comparison of FIGS. 14C and 14D to FIG. 12B shows that the top fold 58 has moved inward and downward by virtue of the pressure applied by the separately movable pressing element 187 and the configuration of the space between the upper and lower die parts that controls the folding of the side wall of the shell during the application of pressure from the pressing element 187. It is also to be noted that during this final step, the score line 32 is once again spread open. Because the nose of the score line 32 is rounded or radiused, this opening of the score line does not result in potentially detrimental fracturing at the score line.

It is also significant to note that because the ledge 68 is formed to be horizontal, less pressure is applied to the ledge 68 than would be the case if, for example, the ledge was angled downward. Because less pressure is applied to the ledge, the integrity of the score line 32 is not adversely affected.

Upon completion of the final step illustrated in FIGS. 14A–14D, the upper die part is lifted and the finished container end closure is removed. Thereafter, the container end closure 20 is applied in a typical fashion to the open upper end of a container. A rust inhibitor (e.g., oil) can be applied to the container end closure in the region of the score line 32 after the last station in the conversion press, possibly through use of a piece of felt dipped in oil.

The above-described method of fabricating the can end closure according to the present invention can be slightly modified by performing the operations performed in the third station in two different stations. Thus, in one station, the further formation of the top fold 58 of the peripheral lid portion 34 and the substantially final formation of the rivet form 52 can be performed, followed by a separate step in which the V-shaped score line 32 is formed.

In developing the present invention, it was recognized that after formation of the score line, the nature of the lid requires several additional bending/pressing steps to complete the fabrication of the lid. Having recognized that carrying out such steps after formation of the score line can have an adverse affect on the integrity and other characteristics of the score line, and thus the lid as a whole, it was discovered that providing a V-shaped score line allows the subsequent fabrication steps to be performed without adversely affecting the score line. It was also found that a V-shaped score line with a sharp nose is susceptible to fracture formation during the subsequent fabrications steps because the score line is closed and opened. Thus, it was discovered that providing a rounded or radiused nose on the V-shaped score line would alleviate much of problems encountered using a V-shaped score line with a sharp angled nose.

It is thus seen that the use of the V-shaped score line with a rounded or radiused nose makes it possible to mass produce a container end closure which provides safe edges on both the removed central lid portion as well as the peripheral lid portion remaining on the container. A variety of other features discussed above also contribute in this regard. For example, the increased nose spread in the region of the lid on either side of the opening tab nose. This feature is significant from the standpoint of allowing a sufficient circumferential extent of the score line to be severed during the upward pivoting movement of the opening tab. If the score line is not severed along a sufficient enough circumferential extent, the ability to remove the central lid portion is severely restricted because the circumferential portion of the score line which must still be severed may be too great to be able to sever by pulling upwardly on the opening tab.

The orienting mechanisms described above (i.e., the recessed central panel, the linear ridge and the rivet form) also play an important role. To produce the container end closures at a rate sufficient to make them commercially viable, the shells used to form the end closures must be advanced at a very high rate of speed. This thus requires that the shells be quickly and extremely accurately positioned and oriented at each station.

Further, as discussed above, the horizontal ledge at the upper end of the container end closure provides several advantages such as facilitating the removal of process water by virtue of the more open space in the area of the score line and avoiding application of excessive pressure to the sidewall of the lid where the ledge is formed that might adversely affect the score line. It has been found that a container end closure in accordance with the present invention is much less susceptible to becoming damaged if dropped (i.e., it has a much greater abuse resistance) than typical lid structures provided with a non-safe lift and pull opening tab. The horizontal ledge also imparts versatility as it allows the container to be opened with either the opening tab or with a can opener.

As described above, the present invention provides a container end closure which, upon opening, provides a safe edge on the removed central lid portion as well as on the peripheral lid portion remaining on the container. There may be instances in which it is only necessary to provide a safe edge on the removed central lid portion. It is thus possible to utilize the various advantageous aspects of the present invention in the context of a container end closure in which only the removable central lid portion is designed to be safe when separated from the peripheral lid portion. Such a container end closure is illustrated in FIG. 15 which depicts one-half of the container end closure in the area where the opening tab is secured.

The container end closure 220 shown in FIG. 15 includes a lid 224 and an opening tab 226 secured to the lid 224 by way of a flattened rivet 252. The lid 224 possesses a V-shaped score line 232 possessing all of the features and characteristics of the score line 32 described above. The portion of the lid 224 that is located outwardly of or contiguous with the outer side of the tear line 232 constitutes the peripheral lid portion 234 while the portion of the lid 224 located inwardly of or contiguous with the inner side of the score line 232 constitutes the central lid portion 236. The central lid portion 236 includes a bottom fold 240 and an intermediate fold 238 overlying the bottom fold 240. The folds 238, 240 are the same as the folds 38, 40 in the embodiment described earlier. Indeed, the central lid portion 236 in the embodiment shown in FIG. 15 is the same as the central lid portion 36 described above. The bottom fold 240 extends radially outwardly beyond the score line 232 to provide the same safe edge feature associated with the central lid portion in the embodiment described above.

The difference between the container end closure shown in FIG. 15 and the container end closure described above is that the intermediate fold 56 on the peripheral lid portion 34 and the top fold 58 on the peripheral lid portion 34 are not provided on the peripheral lid portion of the container end closure shown in FIG. 15. Instead, from the score line 232, the peripheral lid portion 234 of the lid illustrated in FIG. 5 progressively defines a downwardly and outwardly extending portion 241 and a vertically upward extending portion 243. The peripheral lid portion 234 also includes a horizontal ledge 268, a vertically extending portion 270 that merges into an outwardly curved portion 272 terminating in a curled end 274. The horizontal ledge 268, the vertically extending portion 270, the outwardly curved portion 272 and the curled end 274 are the same as in the embodiment described above.

When the container end closure shown in FIG. 15 is opened with the central lid portion 236 separated and removed from the remaining peripheral lid portion 234, the sharp edge on the removed central lid portion 236 is rendered safe by the bottom fold 240 in the same manner as described above. The edge on the peripheral lid portion 234 remaining on the container is not rendered safe in the same manner though.

The method of manufacturing the container end closure shown in FIG. 15 is similar to that described above, with variations being incorporated to account for the absence of a safe mechanism for the peripheral lid portion 234. Because the method of fabricating the closure shown in FIG. 15 is generally the same as that described previously, a detailed description will not be repeated here. Instead, the general differences between the two methods will be discussed.

The fabrication method for forming the closure illustrated in FIG. 15 involves initially producing a drawn shell with a spin curled outer periphery in the same manner described above and applying a compound sealant on the underside of the outer periphery of the shell. The shell possesses a sidewall that is shorter than that used to form the container end closure shown in FIG. 2 because in the embodiment of the closure shown in FIG. 15 it is not necessary to form the two folds for providing a safe edge on the peripheral lid portion.

The resulting shell is then formed into the container end closure shown in FIG. 15 through use of a conversion press similar to the one described above except for modifications to the tooling to account for the absence of a safe mechanism for the peripheral lid portion 234. The first stage of the fabrication process is similar to the first stage described above in that the linear ridge 230 and the initial configuration of the rivet form 252 are formed in the shell having the centrally located recess 228. As in the embodiment described above, the ridge, the centrally located recess 228 and the rivet form 252 are used in all subsequent steps to radially locate/position the shell and rotationally orient the shell. In this first station, the formation of the intermediate fold 238 is also started. The main difference between the first stage here and the first stage described above is that the vertical wall lying immediately below the horizontal ledge

268 is shorter in the case of the fabrication of the FIG. 15 embodiment. The reason is because that portion of the sidewall need not be folded to form the folds for providing a safe edge on the peripheral lid portion.

The shell is then transferred to the second station at which, like the second station described above and illustrated in FIGS. 10A and 10B, the bottom fold 240 of the central lid portion 236 is formed, the formation of the intermediate fold 238 which was begun in the first station proceeds further, and the rivet for securing the opening tab in place is further formed. In addition, the horizontal ledge 268 can be formed at this station rather than at the third station.

Upon transfer to the third station, the score line 232 is formed. The other fabrication steps carried out at the third station in the first described embodiment relate to the formation of the folds on the peripheral lid portion. Because the FIG. 15 embodiment does not include such folds, those fabrication steps are not performed here.

The shell is then transferred to the fourth station which is substantially the same as the fourth station described above in that further folding of the bottom fold 240 of the central lid portion 236 is effected and the folding of the intermediate fold 238 of the central lid portion 36 continues.

In the fifth station, the opening tab 226 is applied to the lid 224 in the manner described above in connection with FIG. 13. The shell is then advanced to the sixth and final station that is substantially the same as the sixth station described above in connection with FIGS. 14A–14D. Here, a force is applied to the opening tab to produce an increased nose spread in the region of the nose of the opening tab. The final formation of the folds in the peripheral lid portion are not carried out because such folds are not included in the FIG. 15 embodiment. At this point, the fabrication of the container end closure is completed, except for the possible application of a rust inhibitor in the region of the score line as described earlier.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. Method of fabricating a safe container end closure comprising:

positioning a shell in a fabricating machine, the shell including a bottom wall and a sidewall extending upwardly from the bottom wall;

forming first and second folds in the sidewall of the shell, the first fold opening inwardly and the second fold opening outwardly;

pressing a V-shaped die element having a rounded nose possessing a radius against the sidewall of the shell at a place on the sidewall located radially inwardly of the radially outermost extent of the first fold to form in the sidewall a V-shaped score line having a rounded nose possessing a radius, the V-shaped score line dividing the sidewall of the shell into a central lid portion positioned on an inner side of the score line and a peripheral lid portion positioned on an outer side of the score line, the V-shaped score line permitting the central lid portion to be severed from the peripheral lid portion; and securing an opening tab to the bottom wall of the shell so that a nose of the opening tab is positioned adjacent the score line.

2. Method of fabricating a safe container end closure according to claim 1, including curling an outer peripheral portion of the shell, the shell having a vertically extending portion located inwardly of the curled outer peripheral portion, and forming a horizontal ledge adjacent the vertically extending portion.

3. Method of fabricating a safe container end closure according to claim 1, including forming third and fourth folds in the peripheral lid portion, the third fold opening inwardly and the fourth fold opening outwardly, the fourth fold having a radially innermost portion that extends radially inwardly of the score line.

4. Method of fabricating a safe container end closure according to claim 1, including forming a gap between the score line and a portion of the central lid portion underlying the score line during the forming of the first and second folds in the sidewall, and including increasing the gap over only a portion of a circumferential extent of the central lid portion.

5. Method of fabricating a safe container end closure according to claim 4, wherein said step of increasing the gap over only a portion of a circumferential extent of the central lid portion includes increasing the gap at a location where the nose of the opening tab is positioned.

6. Method of fabricating a safe container end closure according to claim 4, wherein said step of increasing the gap over only a portion of a circumferential extent of the central lid portion includes applying a force to the nose of the opening tab.

7. Method of fabricating a safe container end closure according to claim 1, including forming a centrally located recess in the bottom wall of the shell and forming an upstanding ridge in the bottom wall, and using the recess and the linear ridge to radially position and rotationally orient the shell.

8. Method of fabricating a safe container end closure comprising:

positioning a shell in a fabricating machine, the shell including a bottom wall and a sidewall extending upwardly from the bottom wall;

forming first and second folds in the sidewall of the shell, the first fold opening inwardly and the second fold opening outwardly;

pressing a V-shaped die element with a rounded nose against the sidewall of the shell at a place on the sidewall located radially inwardly of the radially outermost extent of the first fold and positioning a rounded anvil on a surface of the sidewall of the lid that is opposite to a surface against which the V-shaped die is pressed to form in the sidewall a V-shaped score line having a rounded nose, the V-shaped score line dividing the sidewall of the shell into a central lid portion positioned on an inner side of the score line and a peripheral lid portion positioned on an outer side of the score line, the V-shaped score line permitting the central lid portion to be severed from the peripheral lid portion; and securing an opening tab to the bottom wall of the shell so that a nose of the opening tab is positioned adjacent the score line.

9. Method of fabricating a safe container end closure, comprising:

positioning in a fabricating machine a shell that includes a bottom wall and a sidewall extending upwardly from the bottom wall;

forming first and second folds in the sidewall of the shell, the first fold opening inwardly and the second fold opening outwardly;

forming a score line in the sidewall of the shell at a place on the sidewall located radially inwardly of the radially outermost extent of the first fold to divide the sidewall of the shell into a central lid portion positioned on an inner side of the score line and a peripheral lid portion positioned on an outer side of the score line, the score line permitting the central lid portion to be severed from the peripheral lid portion, the second fold defining a gap between the score line and a portion of the central lid portion lying below the score line, the gap extending around the circumferential extent of the central lid portion and said gap being greater over a portion of the circumferential extent of the central lid portion than at another portion of the circumferential extent of the central lid portion; and securing an opening tab to the bottom wall of the shell so that a nose of the opening tab is positioned adjacent the score line.

10. Method of fabricating a safe container end closure according to claim 9, wherein said gap is formed to be greater over the portion of the circumferential extent of the central lid portion that includes a point at which the noise of the opening tab is located.

11. Method of fabricating a safe container end closure according to claim 9, wherein said gap is formed to be greater over the portion of the circumferential extent of the central lid portion that includes a point at which the noise of the opening tab is located and regions on either side of said point.

12. Method of fabricating a safe container end closure according to claim 9, wherein said gap is formed to be greater over the portion of the circumferential extent of the central lid portion by increasing the gap after said first and second folds have been at least partially formed.

13. Method of fabricating a safe container end closure according to claim 12, wherein said step of increasing the gap includes applying a force to the nose of the opening tab after the opening tab has been secured to the bottom wall of the shell.

14. Method of fabricating a safe container end closure according to claim 9, including forming third and fourth folds in the peripheral lid portion of the shell so that a radially innermost extent of the fourth loop is located radially inwardly of the score line.

15. Method of fabricating a safe container end closure according to claim 9, wherein said step of forming a score line includes pressing a V-shaped die element having a radiused nose against one side of the sidewall of the shell.

16. Method of fabricating a safe container end closure according to claim 15, including positioning a rounded anvil against the sidewall of the shell in opposing relation to the V-shaped die element.

17. Method of fabricating a safe container end closure according to claim 9 including forming a centrally located recess in the bottom wall of the shell and forming a linear ridge in the bottom wall of the shell, and using said centrally located recess and said linear ridge to radially locate and rotationally orient the shell during the forming of the first and second folds.

18. Method of fabricating a safe container end closure, comprising:

placing a shell in a fabricating machine which successively advances the shell along a plurality of stations to form the shell into a safe container end closure, the shell having a bottom wall and a sidewall;

forming a first locating means in the bottom wall of the shell;

forming a second locating means in the bottom wall of the shell;

forming a rivet form in the bottom wall of the shell;

forming first and second folds in the sidewall of the shell, the first fold opening inwardly and the second fold opening outwardly;

forming a score line in the sidewall of the shell at a place on the sidewall located radially inwardly of the radially outermost extent of the first fold to divide the sidewall of the shell into a central lid portion positioned on an inner side of the score line and a peripheral lid portion positioned on an outer side of the score line, the score line permitting the central lid portion to be severed from the peripheral lid portion;

securing an opening tab to the bottom wall of the shell so that a nose of the opening tab is positioned adjacent the score line; and radially locating the shell at at least some of said stations through use of said first locating means and rotationally orienting the shell at at least some of said stations through use of said second locating means to ensure proper radial location and rotational orientation of the shell at the stations.

19. Method of fabricating a safe container end closure according to claim 18, wherein said step of radially locating the shell and rotationally orienting the shell includes engaging the first locating means with a first element provided on the fabrication machine and engaging the second locating means with a second element provided on the fabrication machine.

20. Method of fabricating a safe container end closure according to claim 18, wherein the step of forming the first locating means in the includes forming a centrally located recess in the bottom wall of the shell.

21. Method of fabricating a safe container end closure according to claim 20, wherein the step of forming the second locating means includes forming a linear ridge in the bottom wall of the shell.

22. Method of fabricating a safe container end closure according to claim 18, including curling an outer peripheral portion of the shell, the shell having a vertically extending portion located inwardly of the curled outer peripheral portion, and forming a horizontal ledge adjacent the vertically extending portion.

23. Method of fabricating a safe container end closure according to claim 18, including forming third and fourth folds in the peripheral lid portion, the third fold opening inwardly and the fourth fold opening outwardly, the fourth fold having a radially innermost portion that extends radially inwardly of the score line.

24. Method of fabricating a safe container end closure according to claim 18, including forming a gap between the score line and a portion of the central lid portion underlying the score line during the forming of the first and second folds in the sidewall, and including increasing the gap over only a portion of a circumferential extent of the central lid portion.

25. Method of fabricating a safe container end closure according to claim 18, wherein said gap is increased over the portion of the circumferential extent of the central lid portion that includes a point at which the noise of the opening tab is located and regions on either side of said point.

26. Method of fabricating a safe container end closure according to claim 18, wherein said step of forming a score line includes pressing a V-shaped die element having a rounded nose against one side of the sidewall of the shell.

27. Method of fabricating a safe container end closure according to claim 26, including positioning a rounded anvil against the sidewall of the shell in opposing relation to the V-shaped die element.

28. Method of fabricating a safe container end closure comprising:

positioning a shell in a fabricating machine, the shell including a bottom wall and a sidewall extending upwardly from the bottom wall;

forming first and second folds in the sidewall of the shell, the first fold opening inwardly and the second fold opening outwardly;

pressing a V-shaped die element against the sidewall of the shell at a place on the sidewall located radially inwardly of the radially outermost extent of the first fold to form in the sidewall a V-shaped score line, the V-shaped die element being oriented non-perpendicular to said sidewall during formation of the V-shaped score line so that the sides of the V-shaped score line are of different length, the V-shaped score line dividing the sidewall of the shell into a central lid portion positioned on an inner side of the score line and a peripheral lid portion positioned on an outer side of the score line, the V-shaped score line permitting the central lid portion to be severed from the peripheral lid portion; and securing an opening tab to the bottom wall of the shell so that a nose of the opening tab is positioned adjacent the score line.

* * * * *